US007527365B2

(12) United States Patent
Mori

(10) Patent No.: US 7,527,365 B2
(45) Date of Patent: May 5, 2009

(54) INITIAL FILLING METHOD FOR FUNCTIONAL LIQUID DROPLET EJECTION HEAD, INITIAL FILLING APPARATUS FOR FUNCTIONAL LIQUID DROPLET EJECTION HEAD, FUNCTIONAL LIQUID DROPLET EJECTION HEAD, FUNCTIONAL LIQUID SUPPLYING APPARATUS, LIQUID DROPLET EJECTION APPARATUS, MANUFACTURING METHOD FOR ELECTRO-OPTIC DEVICE, ELECTRO-OPTIC DEVICE, AND ELECTRONIC APPARATUS

(75) Inventor: Toshimasa Mori, Suwa (JP)

(73) Assignee: Seiko Epson Corporation (JP)

( * ) Notice: Subject to any disclaimer, the term of this patent is extended or adjusted under 35 U.S.C. 154(b) by 485 days.

(21) Appl. No.: 11/320,442

(22) Filed: Dec. 28, 2005

(65) Prior Publication Data

US 2006/0158488 A1 Jul. 20, 2006

(30) Foreign Application Priority Data

Jan. 17, 2005 (JP) ..... 2005-009450

(51) Int. Cl.

| | |
|---|---|
| ***B41J 2/17*** | (2006.01) |
| ***B41J 2/175*** | (2006.01) |
| ***B65B 1/04*** | (2006.01) |
| ***B65B 31/04*** | (2006.01) |
| ***B67C 3/00*** | (2006.01) |
| ***B67D 5/64*** | (2006.01) |
| ***B43L 25/02*** | (2006.01) |

(52) U.S. Cl. ..... 347/84; 347/85; 141/2; 141/8; 141/18; 141/65; 222/165; 222/583

(58) Field of Classification Search ..... 141/2, 141/4, 5, 7, 8, 18, 21, 45, 56, 59, 65, 67, 141/82; 347/2, 28, 29, 35, 84–87; 222/583, 222/165

See application file for complete search history.

(56) References Cited

U.S. PATENT DOCUMENTS 5,537,134 A * 7/1996 Baldwin et al. ..... 347/85

(Continued)

FOREIGN PATENT DOCUMENTS

CN 1253037 5/2000

(Continued)

*Primary Examiner*—Stephen D Meier
*Assistant Examiner*—Rene Garcia, Jr.
(74) *Attorney, Agent, or Firm*—Harness, Dickey & Pierce, P.L.C.

(57) ABSTRACT

There is provided an initial filling method for a functional liquid droplet ejection head in which a filling liquid consisting essentially of a functional liquid or a solvent thereof is initially filled in a passage of a functional liquid drop-let-ejection-head for ejecting a functional liquid droplet on a workpiece. The method includes: a sealing step of sealing a functional liquid introducing port of the functional liquid droplet ejection head communicating with the passage of the head; an immersing step of immersing a head main body of the functional liquid droplet ejection head in the filling liquid stored in a sealed vessel; a pressure-reducing step of reducing pressure inside the sealed vessel to a predetermined degree of vacuum by exhausting the atmosphere inside the sealed vessel; and a pressure-restoring step of restoring the pressure inside the sealed vessel after the pressure-reducing step.

8 Claims, 26 Drawing Sheets

U.S. PATENT DOCUMENTS 5,917,523 A * 6/1999 Baldwin et al. ..... 347/85
6,199,600 B1 3/2001 Ahn et al.

FOREIGN PATENT DOCUMENTS

JP 05-124198 5/1993
JP 09-226140 9/1997
JP 09226140 A * 9/1997
JP 2000-229271 8/2000
JP 2004-294113 10/2004
JP 2004294113 A * 10/2004
JP 2005-001302 1/2005

* cited by examiner

INITIAL FILLING METHOD FOR FUNCTIONAL LIQUID DROPLET EJECTION HEAD, INITIAL FILLING APPARATUS FOR FUNCTIONAL LIQUID DROPLET EJECTION HEAD, FUNCTIONAL LIQUID DROPLET EJECTION HEAD, FUNCTIONAL LIQUID SUPPLYING APPARATUS, LIQUID DROPLET EJECTION APPARATUS, MANUFACTURING METHOD FOR ELECTRO-OPTIC DEVICE, ELECTRO-OPTIC DEVICE, AND ELECTRONIC APPARATUS

The entire disclosure of Japanese Patent Application No. 2005-009450, filed Jan. 17, 2005, is expressly incorporated by reference herein.

BACKGROUND

1. Technical Field

The present invention relates to an initial filling method for a functional liquid droplet ejection head in which a filling liquid is initially filled in a passage of the functional liquid droplet ejection head for ejecting a functional liquid, on a workpiece, an initial filling apparatus for a functional liquid droplet ejection head, a functional liquid droplet ejection head, a functional liquid supplying apparatus, a liquid droplet ejection apparatus, a manufacturing method for an electro-optic device, an electro-optic device, and an electronic apparatus.

2. Related Art

Known ink jet heads (functional liquid droplet ejection heads) are of a type which ejects an ink on a recording medium. Such functional liquid droplet ejection heads have a plurality of nozzles disposed at short intervals and a passage for supplying a functional liquid to respective nozzles so as to eject a functional liquid (ink) at high resolution. In this case, since the passage of the head is connected to the plurality of nozzles disposed at short intervals in its structure, it is branched into a plurality of branched passages corresponding to the respective nozzles, and the branched passages are bended at a right angle at a plurality of portions to be connected to the respective nozzles.

The nozzles and the passage of the head previously have an oxide layer formed therein with oxidation treatment, plasma treatment, or the like, thereby having an enhanced hydrophilicity to a hydrophilic functional liquid (ink). As a result, air bubbles are prevented from being left in the passage of the head when an ink is initially filled. JP A-5-124198 is an example of related art.

In the manufacturing process of an organic EL (electro luminescence) device as an applied technology of an ink jet head, an EL light-emitting material or the like is used for a functional liquid. Since the functional liquid uses a strongly acidic or alkaline solution or an organic solvent solution, however, the use of the functional liquid may not only destroy an oxide layer but also cause the peeled oxide layer to get mixed with the functional liquid itself.

SUMMARY

It is an advantage of the invention to provide an initial filling method for a functional liquid droplet ejection head capable of easily preventing air bubbles from being left in the functional liquid droplet ejection head at the time of an initial filling, an initial filling apparatus for a functional liquid droplet ejection head, a functional liquid droplet ejection head, a functional liquid supplying apparatus, a liquid droplet ejection apparatus, a manufacturing method for an electro-optic device, an electro-optic device, and an electronic apparatus.

According to a first aspect of the invention, there is provided an initial filling method for a functional liquid droplet ejection head in which a filling liquid consisting essentially of a functional liquid or a solvent thereof is initially filled in a passage of a functional liquid droplet ejection head for ejecting a functional liquid droplet on a workpiece. The method comprises: a sealing step of sealing a functional liquid introducing port of the functional liquid droplet ejection head communicating with the passage of the head; an immersing step of immersing a head main body of the functional liquid droplet ejection head in the filling liquid stored in a sealed vessel; a pressure-reducing step of reducing pressure inside the sealed vessel to a predetermined degree of vacuum by exhausting the atmosphere inside the sealed vessel; and a pressure-restoring step of restoring the pressure inside the sealed vessel after the pressure-reducing step.

According to a second aspect of the invention, there is provided an initial filling apparatus for a functional liquid droplet ejection head, which initially fills a filling liquid consisting essentially of a functional liquid or a solvent thereof in a passage of the functional liquid droplet ejection head for ejecting a functional liquid droplet on a workpiece. The apparatus comprises: a sealed vessel for storing the filling liquid therein; a head supporting unit for supporting the functional liquid droplet ejection head whose functional liquid introducing port communicating with the passage of the head is previously-sealed in such a manner as to be immersed in the filling liquid; a pressure-reducing unit communicating with the sealed vessel for reducing pressure inside the sealed vessel to a predetermined degree of vacuum by exhausting the atmosphere inside the sealed vessel; and a pressure-restoring unit for restoring the pressure inside the sealed vessel after the degree of vacuum is kept for predetermined hours.

According to these configurations, the functional liquid droplet ejection head whose functional liquid introducing ports are sealed is immersed in the filling liquid of the sealed vessel and the pressure thereof is reduced to a predetermined degree of vacuum, thereby exhausting the atmosphere inside the sealed vessel including that present in the passage of the functional liquid droplet ejection head. As a result, the passage of the functional liquid droplet ejection head is kept in vacuum, and the filling liquid is also degassed. Furthermore, when the pressure inside the sealed vessel is raised in the pressure-restoring step, the filling liquid intrudes into the passage from the nozzles of the functional liquid droplet ejection head, whereby the passage is filled with the filling liquid. In this case, no atmosphere is present in the passage of the head before the passage is filled with the filling liquid, and the filling liquid is previously degassed. Therefore, it is ensured that no air bubbles are left in the passage of the head.

In view of the above, air bubbles can easily be prevented from being left in the passage of the head without subjecting the passage of the head to surface treatment or the like. Furthermore, as a result of the degassing of the filling liquid, air bubbles occurring in the filling liquid are caused to be dissolved in the surrounding filling liquid. Therefore, even if air bubbles are left at corners of the passage of the head, they can be absorbed in the filling liquid. Note that when tubes are connected to the functional liquid introducing ports, air may intrude thereinto. However, the air is exhausted by a suction operation because the passage of the head is moistened with the filling liquid. As a result, there arises no problem of air bubbles being left. Furthermore, since the pressure-reducing step is performed in a short period of time, a previously degassed filling liquid may be used.

According to a third aspect of the invention, there is provided an initial filling method for a functional liquid droplet ejection head in which a filling liquid consisting essentially of a functional liquid or a solvent thereof is initially filled in a passage of a functional liquid droplet ejection head for ejecting a functional liquid droplet on a workpiece. The method comprises: a pressure-reducing step of reducing pressure inside a sealed vessel to a predetermined degree of vacuum by exhausting the atmosphere inside the sealed vessel in which the filling liquid is filled and the functional liquid droplet ejection head is accommodated; an immersing step of immersing the whole functional liquid droplet ejection head in the filling liquid; and a pressure-restoring step of restoring the pressure inside the sealed vessel after the pressure-reducing step.

According to a fourth aspect of the invention, there is provided an initial filling apparatus for a functional liquid droplet ejection head, which initially fills a filling liquid consisting essentially of a functional liquid or a solvent thereof in a passage of the functional liquid droplet ejection head for ejecting a functional liquid droplet on a workpiece. The apparatus comprises: a sealed vessel for storing the filling liquid therein; a pressure-reducing unit communicating with the sealed vessel for reducing pressure inside the sealed vessel to a predetermined degree of vacuum by exhausting the atmosphere inside the sealed vessel; an elevating unit for elevating the functional liquid droplet ejection head between an immersing position where the whole functional liquid droplet ejection head is immersed in the filling liquid and a pull-up position where the functional liquid droplet ejection head is pulled up from the filling liquid, while supporting the functional liquid droplet ejection head; and a pressure-restoring unit for restoring the pressure inside the sealed vessel after the degree of vacuum is kept for predetermined hours.

According to these configurations, the atmosphere inside the sealed vessel including that present in the functional liquid droplet ejection head is exhausted, and the pressure inside the sealed vessel is reduced to a predetermined degree of vacuum. At that time, the filling liquid is also degassed. Around the time of the pressure-reducing step, the functional liquid droplet ejection head is immersed in the filling liquid, thereby making it possible to fill the passage of the functional liquid droplet ejection head with the degassed filling liquid. As a result, air bubbles can be prevented from being left in the passage of the head.

It is preferable that the immersing step be performed after the pressure-reducing step and before the pressure-restoring step.

It is preferable that the initial filling apparatus for a functional liquid droplet ejection head further comprise a controlling unit for controlling the pressure-reducing unit, the elevating unit, and the pressure-restoring unit, wherein the controlling unit drives: the pressure-reducing unit to reduce pressure inside the sealed vessel to the predetermined degree of vacuum; the elevating unit to immerse the whole functional liquid droplet ejection head in the filling liquid; and the pressure-restoring unit after a lapse of predetermined hours to restore the pressure inside the sealed vessel.

According to these configurations, since the pressure of the functional liquid droplet ejection head is previously reduced to a predetermined degree of vacuum prior to the immersing step, it is possible to exhaust air bubbles and fill the filling liquid in a comparatively short period of time.

It is preferable that the predetermined degree of vacuum be kept for several hours in the pressure-reducing step.

According to this configuration, it is possible to adequately eliminate air bubbles of the functional liquid droplet ejection head and degas the filling liquid.

It is preferable that the predetermined degree of vacuum be smaller than or equal to 1000 Pa and greater than or equal to 100 Pa.

According to this configuration, the sealed vessel can be degassed in the pressure-reducing step, but the degree of vacuum therein is not high enough to evaporate the filling liquid. Therefore, the pressure is reduced in this range, thereby making it possible to efficiently perform an initial filling.

According to a fifth aspect of the invention, there is provided a functional liquid droplet ejection head in which the filling liquid is initially filled either by the initial filling method for a functional liquid droplet ejection head described above or the initial filling apparatus for a functional liquid droplet ejection head described above.

According to this configuration, since the filling liquid is initially filled in such a manner as to prevent air bubbles from being left, it is possible to constitute a functional liquid droplet ejection head which prevents an incomplete ejection.

According to a sixth aspect of the invention, there is provided a functional liquid supplying apparatus for supplying a functional liquid to the functional liquid droplet ejection head described above. The apparatus comprises: a functional liquid tank for storing the functional liquid; and a functional liquid supplying tube for connecting the functional liquid droplet ejection head and the functional liquid tank.

According to this configuration, a functional liquid is supplied to the functional liquid droplet ejection head in which the filing-liquid consisting essentially of a functional liquid or a solvent thereof is initially filled. Therefore, even if the filling liquid left in the functional liquid droplet ejection head gets mixed with the functional liquid when supplied, it is possible to supply a secured functional liquid without causing it to deteriorate.

According to a seventh aspect of the invention, there is provided a liquid droplet ejection apparatus comprising: the functional liquid supplying apparatus described above; a head unit in which the functional liquid droplet ejection head is mounted on a carriage; and a moving mechanism for mounting a workpiece thereon and moving the head unit relative to the workpiece.

According to this configuration, it is possible to perform an imaging operation by the use of the functional liquid droplet ejection head, in which a filling liquid is initially filled, in such a way as to prevent air bubbles from being left. As a result, the yield of a workpiece can be enhanced by preventing an incomplete ejection of the functional liquid droplet ejection head.

According to an eighth aspect of the invention, there is provided a manufacturing method for an electro-optic device, comprising forming a film-deposited portion of functional liquid droplets on the workpiece by the use of the liquid droplet ejection apparatus described above.

According to a ninth aspect of the invention, there is provided an electro-optic device comprising forming a film-deposited portion of functional liquid-droplets on the workpiece by the use of the liquid droplet ejection apparatus described above.

According to these configurations, since the liquid droplet ejection apparatus which prevents an incomplete ejection of the functional liquid droplet ejection head is used, it is possible to manufacture a reliable electro-optic device. Examples of electro-optic devices include a liquid crystal device, an organic EL (Electro-Luminescence) device, an electron emission device, a PDP (Plasma Display Panel) device, an electrophoresis unit, or the like. Note that the electron emission device refers to a concept including a so-called FED (Field Emission Display) device or SED (Surface-Conduction Electron-Emitter Display) device. Moreover, examples of electro-optic devices include devices for forming metal wiring, lens, resist, light diffuser, or the like.

According to a tenth aspect of the invention, there is provided an electronic apparatus incorporating therein an electro-optic device manufactured by the method described above, or incorporating therein an electro-optic device described above.

In this case, an electronic apparatus corresponds to a mobile phone having a so-called flat panel display mounted thereon, a personal computer, various electronic appliances.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, referring to the accompanying drawings, description will be made about a liquid droplet ejection apparatus to which is applied a functional liquid droplet ejection head of the invention and an initial filling apparatus to which is applied an initial filling method for the functional liquid droplet ejection head. The liquid droplet ejection apparatus is built in a production line of a so-called flat panel display and forms light-emitting elements or the like serving as a color filter of a liquid-crystal display device or each pixel of an organic EL (electro-luminescence) device according to a liquid droplet ejection method (ink jet method) using a functional liquid droplet ejection head as an ink jet head. On the other hand, the initial filling apparatus is provided independently of the liquid droplet ejection apparatus and serves to previously fill a filling liquid in a passage of the functional liquid droplet ejection head before the functional liquid droplet ejection head is mounted on the liquid droplet ejection apparatus.

Figure 1:
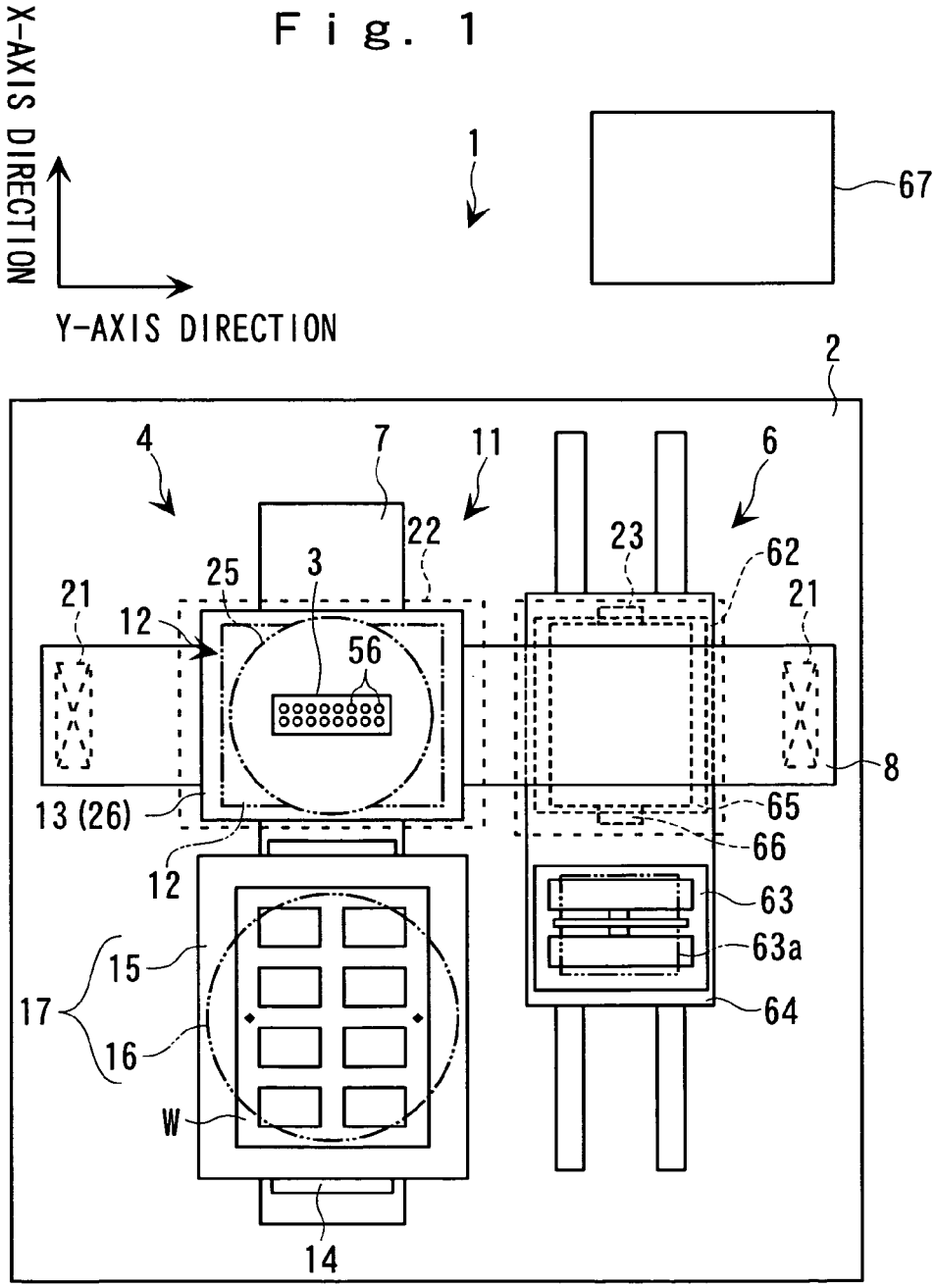
FIG. 1 is a plan schematic diagram of a liquid droplet ejection apparatus.
Figure 2:
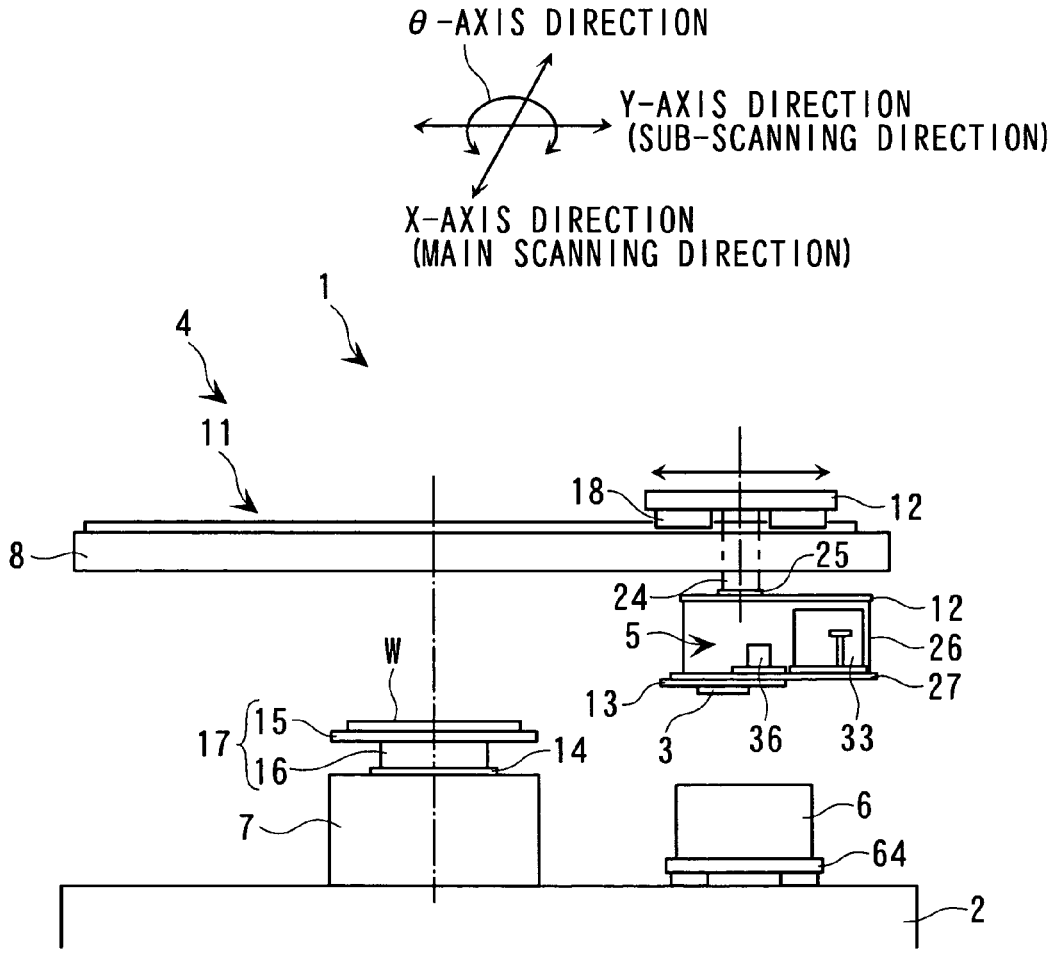
FIG. 2 is a side schematic diagram of the liquid droplet ejection apparatus.

As shown in FIGS. 1 and 2, the liquid droplet ejection apparatus 1 has a base 2, an imaging apparatus 4 having a functional liquid droplet ejection head 3 and mounted on the base 2 in the shape of a cross, a functional liquid supplying apparatus 5 connected to the imaging apparatus 4, and a maintenance apparatus 6 mounted on the base 2 in a manner attached to the imaging apparatus 4. Furthermore, the liquid droplet ejection apparatus 1 is provided with a control apparatus not shown in the figures. In the liquid droplet ejection apparatus 1, the imaging apparatus 4 performs an imaging operation on a workpiece W based on the control by the control apparatus while being supplied with a functional liquid from the functional liquid supplying apparatus 5, and the maintenance apparatus 6 properly performs a maintenance operation on the functional liquid droplet ejection head 3.

On the other hand, as described in detail below, in the initial filling apparatus 67, a sealed vessel 71 having a filling liquid 68 stored therein accommodates the functional liquid droplet ejection head 3, and pressure inside the sealed vessel 71 is reduced, to thereby initially fill a filling liquid in the functional liquid droplet ejection head 3 (see FIG. 5).

The imaging apparatus 4 has an X-Y axis moving mechanism 11 composed of an X-axis table 7 for moving the workpiece W in a main scanning direction (in an X-axis direction) and a Y-axis table 8 located perpendicular to the X-axis table 7, a main carriage 12 movably attached to the Y-axis table 8, and a head unit 13 suspended from the main carriage 12 and having the functional liquid droplet ejection head 3 mounted thereon.

The X-axis table 7 has an X-axis slider 14 driven by an X-axis motor (not shown) constituting a driving system in the X-axis direction, on which a set table 17 composed of a suction table 15, a θ table 16, or the like is movably mounted. Similarly, the Y-axis table 8 has a Y-axis slider 18 driven by a Y-axis motor (not shown) constituting a driving system in the Y axis direction, on which the main carriage 12 supporting the head unit 13 is movably mounted. Note that the X-axis table 7 is disposed in a direction parallel with the X-axis and directly supported by the base 2. On the other hand, the Y-axis table 8 is supported by left and right columns 21 provided on the base 2 in a standing manner and extends in the Y-axis direction in such a way as to stride over the X-axis table 7 and the maintenance apparatus 6 (see FIGS. 1 and 2).

In the liquid droplet ejection apparatus 1, an area where the X-axis table 7 and the Y-axis table 8 cross each other is an imaging area 22 for performing an imaging operation on the workpiece W, and an area where the Y-axis table 8 and the maintenance apparatus 6 cross each other is a maintenance area 23 for performing a function-recovery process on the functional liquid droplet ejection head 3. The head unit 13 faces the imaging area 22 when the imaging operation is performed on the workpiece W and the maintenance area 23 when the function-recovery process is performed.

As shown in FIG. 2, the main carriage 12 is composed of an "I"-shaped suspension member 24 fixed to the Y-axis slider 18 of the Y-axis table 8 from the lower side thereof, a θ-angle rotation mechanism 25 attached to the lower surface of the suspension member 24, for adjusting the angle in the θ direction of the head unit 13, and a carriage main body 26 (carriage) attached underneath the θ-angle rotation mechanism 25 so as to be suspended therefrom. The carriage main body 26 has a framework (not shown) serving as a positioning mechanism, to which is fixed the head unit 13 through a support frame 27 described below (see FIG. 3) in a positioned state.

Figure 3:
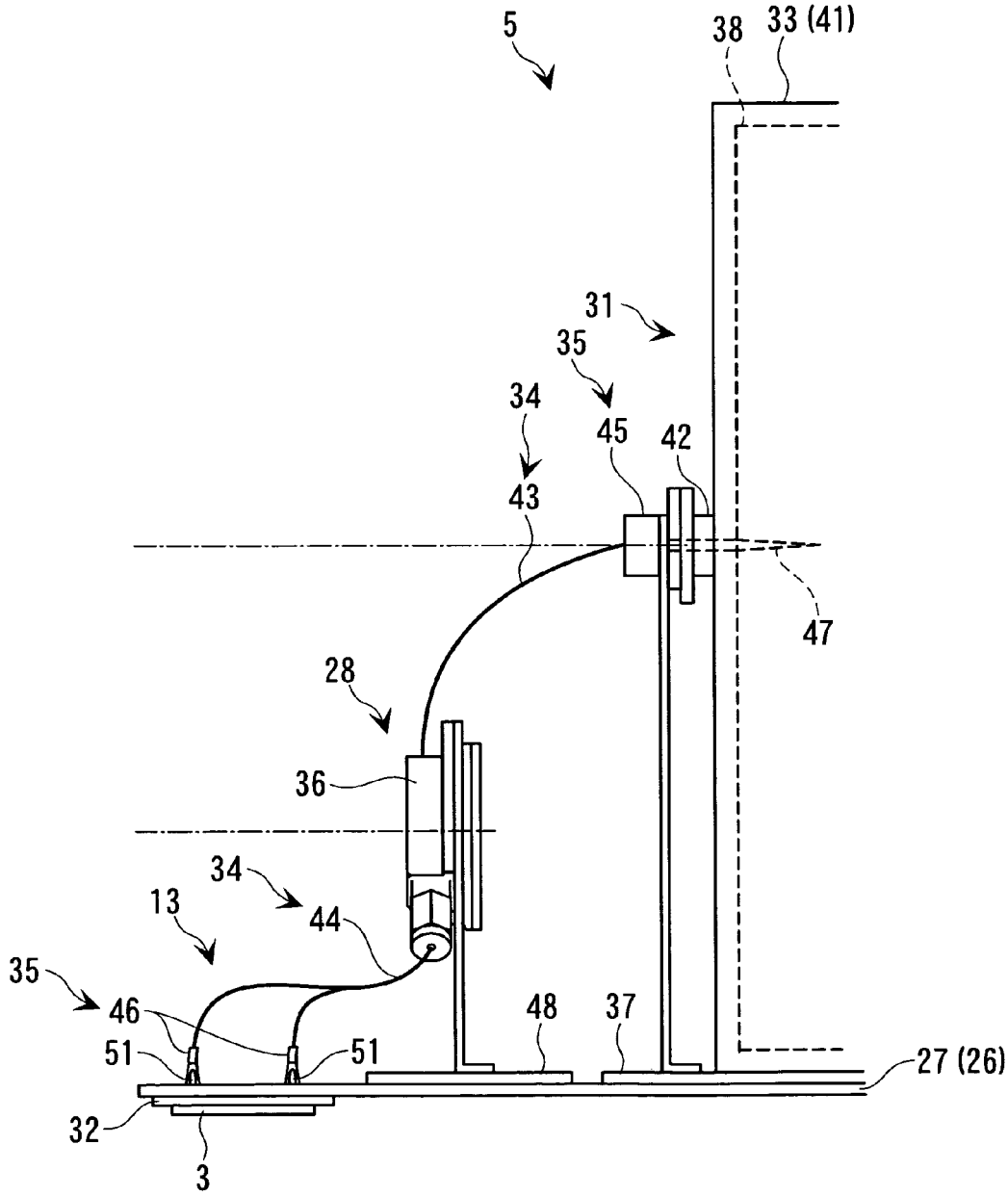
FIG. 3 is a side schematic diagram of a functional liquid supplying apparatus.

As shown in FIG. 3, the support frame 27 is formed in a substantially quadrate frame-shape. The head unit 13, the valve unit 28, and the tank unit 31 are mounted on the support frame in this order in a positioned state. Note that the support frame 27 is attached with a pair of handles (not shown), thereby permitting the user to detachably put the support frame 27 in the main carriage 12.

As shown in FIG. 3, the head unit 13 has the functional liquid droplet ejection head 3 and a head plate 32 having the functional liquid droplet ejection head 3 mounted thereon through a head holding member (not shown). The head plate 32 is detachably supported by the support frame 27, and the head unit 13 is positioned and mounted on the carriage main body 26 through the support frame 27. Note that the support frame 27 supports a valve unit 28 and a tank unit 31 along with the head unit 13.

As shown in FIG. 3, the functional liquid supplying apparatus 5 is mounted on the support frame 27. The functional liquid supplying apparatus includes a tank unit 31 having a functional liquid tank 33 for storing a functional liquid, a functional liquid supplying tube 34 for connecting the functional liquid tank 33 and the functional liquid droplet ejection head 3, a connection fitting 35 for connecting the functional liquid supplying tube 34 to the functional liquid tank 33 and the functional liquid droplet ejection head 3, and a valve unit 28 having a pressure-regulating valve 36 interposed in a plurality of the functional liquid supplying tubes 34.

The tank unit 31 is composed of the functional liquid tank 33, a setting portion (not shown) for setting the functional liquid tank, and a tank plate 37 for supporting the functional liquid tank 33. As shown in FIG. 3, the functional liquid tank 33 is of a cartridge type and has a functional liquid package 38 having a functional liquid vacuum-packed therein and a resinous cartridge casing 41 for accommodating the functional liquid package 38. Note that the functional liquid to be stored in the functional liquid package 38 is previously degassed and has an approximate zero amount of a dissolved gas.

The functional liquid package 38 is of a bag type formed by superposing and thermally-welding two rectangular (flexible) film sheets together and is provided with a resinous supplying port 42 for supplying a functional liquid. The supplying port 42 has a communication opening (not shown) formed therein to be communicated with the inside of the package. The communication opening is closed by a closing member (not shown) made of an elastic material having corrosion resistance to functional liquids, thereby preventing air (oxygen) or humidity from entering in the communication opening.

The functional liquid supplying tube 34 (functional liquid supplying passage) has a tank-side tube 43 for connecting the corresponding functional liquid tank 33 and the pressure-regulating valve 36, and a head-side tube 44 for connecting the corresponding pressure-regulating valve 36 and the functional liquid droplet ejection head 3.

As shown in FIG. 3, the connection fitting 35 has a tank-side adapter 45 for connecting the functional liquid tank 33 and the tank-side tube 43 and a head-side adapter 46 for connecting the functional liquid droplet ejection head 3 and the head-side tube 44. The tank-side adapter 45 has a connecting needle 47 provided therein, the center of which is formed with a passage. The connecting needle 47 is connected to the functional liquid package 38 after being penetrated and inserted into the closing member (not shown) of the functional liquid package 38 (communication opening).

The valve unit 28 has the pressure-regulating valve 36 and a valve plate 48 for supporting the pressure-regulating valve (see FIG. 3). Although omitted in the figure, the pressure-regulating valve 36 has a primary chamber communicating with the functional liquid tank 33, a secondary chamber communicating with the functional liquid droplet ejection head 3 and having a functional liquid pressure-reduced therein, a communication passage communicating the primary chamber and the secondary chamber, and a valve disc provided in the communication passage. The pressure-regulating valve constitutes a so-called pressure-reducing valve. The pressure-regulating valve 36 reduces the pressure of a functional liquid to approximate atmospheric pressure, thereby preventing a liquid from leaking out of the functional liquid droplet ejection head 3. Furthermore, the primary-chamber side and the secondary-chamber side are separated by the valve disc, thereby preventing pulsation or the like generated on the functional liquid tank 33 side from being transmitted to the functional liquid droplet ejection head 3 (damper function). A functional liquid supplied from the functional liquid tank 33 is supplied to the functional liquid droplet ejection head 3 by way of the tank-side tube 43, the pressure-regulating valve 36, and the head-side tube 44.

Figure 4:
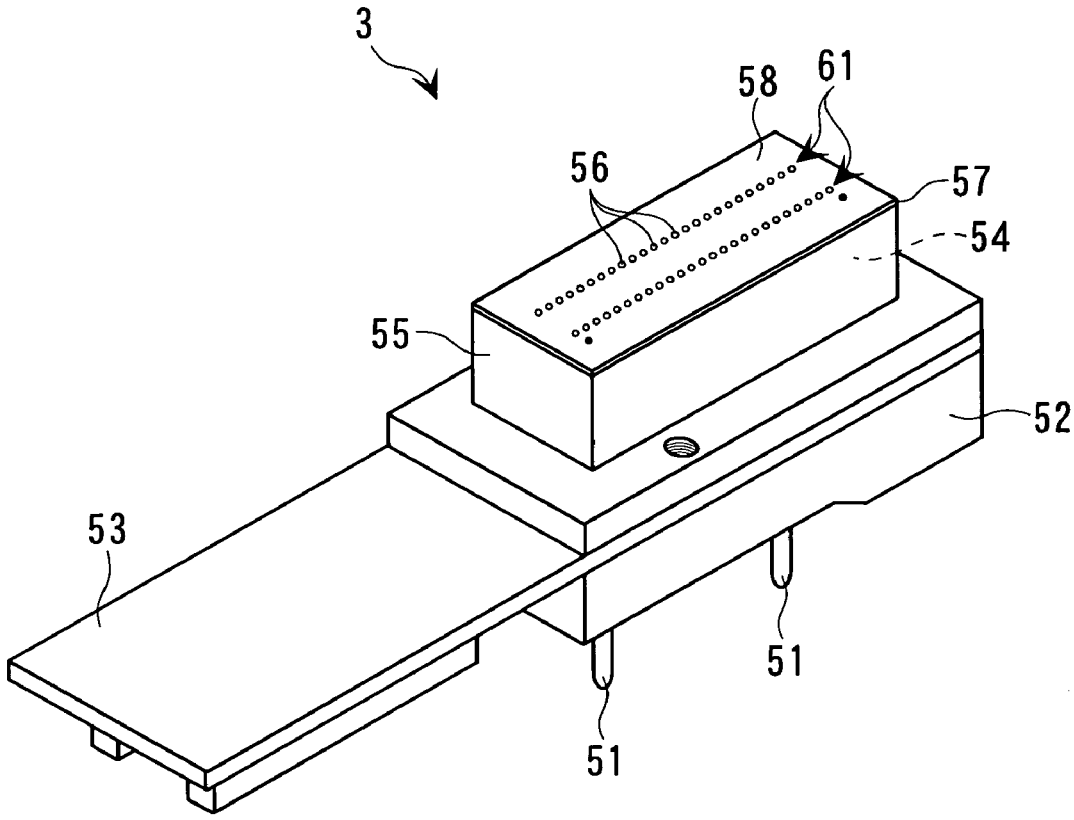
FIG. 4 is an external perspective view of a functional liquid droplet ejection head.

As shown in FIG. 4, the functional liquid droplet ejection head 3 is of a so-called duplex type and has a functional liquid introducing section 52 having duplex-type connecting needles 51 (functional liquid introducing port), a duplex-type head substrate 53 connected to the functional liquid introducing section 52, and a head main body 55 connected to the lower part of the head substrate 53 and having inside a passage filled with a functional liquid. The connecting needles 51 are connected to the functional liquid supplying tube 34 not shown in the figure and supply a functional liquid to the head main body 55 of the functional liquid droplet ejection head 3. The head main body 55 has a nozzle plate 57 having a nozzle surface 58, on which a plurality of ejection nozzles 56 with an opening are formed, a pressure chamber (not shown) having a piezoelectric element (not shown) provided therein, and branched passages (not shown) for liquid-connecting the corresponding pressure chamber and the ejection nozzle 56. On the nozzle surface 58 are formed nozzle rows 61 composed of a plurality (180 pieces) of the ejection nozzles 56 communicating with each of the branched passages. In other words, the passage 54 of the head is composed of the connecting needles 51 (functional liquid introducing port), the pressure chamber, the branched passages, and passages connected to the ejection nozzles 56. When the functional liquid droplet ejection head 3 is driven to eject functional liquid droplets, the pressure chamber is activated by pump action to eject functional liquid droplets from the ejection nozzles 56.

Referring next to FIG. 1, description will be made about the maintenance apparatus 6. The maintenance apparatus 6 serves to seal a nozzle surface of the functional liquid droplet ejection head 3 to prevent the ejection nozzles 56 from drying when the liquid droplet ejection apparatus 1 is not in operation. The maintenance apparatus has a storage and suction unit 62 for sucking and removing a thickened functional liquid from the ejection nozzles 56 of the functional liquid droplet ejection head 3 and a wiping unit 63 for wiping off stains adhered to the nozzle surface 58 of the functional liquid droplet ejection head 3. The both units 62 and 63 described above are installed on the moving table 64, which is mounted on the base 2 extending in the X-axis direction thereof, and can be moved in the X-axis direction by the moving table 64.

The storage and suction unit 62 has a sealing cap 65 serving also as a flushing box for receiving liquid droplets extra-ejected by the functional liquid droplet ejection head 3, a cap elevating mechanism 66 for elevating the sealing cap 65, a suction mechanism (not shown) composed of an ejector, a pump, or the like, for sucking the functional-liquid droplet ejection head 3 while being connected to the sealing cap 65, and a waste liquid tank (not shown) for collecting waste liquids sucked and removed by the suction mechanism. When the imaging operation is in the suspend mode, the functional liquid droplet ejection head 3 is moved to the maintenance area 23 on the moving table 64, and the sealing cap 65 receives the flushing (extra-ejection) of the functional liquid droplet ejection head 3 at a position spaced from the functional liquid droplet ejection head 3. When the functional liquid droplet ejection head 3 is in a standby state, the sealing cap 65 is completely lifted up to cap the nozzle surface 58 of the functional liquid droplet ejection head 3 and seal all the ejection nozzles 56 of the functional liquid droplet ejection head 3. Subsequently, when the capped functional liquid droplet ejection head 3 is re-driven, the suction mechanism is driven as required to prevent thickened functional liquids from clogging in the nozzles, and the thickened functional liquids are thus sucked from the ejection nozzles 56. Note that this suction operation is applied also when a functional liquid is filled in the functional liquid droplet ejection head 3.

As shown in the same figure, the wiping unit 63 is provided with a wiping sheet 63*a* which can be freely fed out and taken up. With this structure, while the fed-out wiping sheet 63*a* is transferred, the wiping unit 63 is moved in the X-axis direction by the moving table 64 to wipe off the nozzle surface 58 of the functional liquid droplet ejection head 3. As a result, functional liquids adhered to the nozzle surface of the functional liquid droplet ejection head 3 are removed by the suction operation, and curved flying of ejected functional liquid droplets, or the like is prevented. Note that it is preferable to install as the maintenance unit 6 an ejection inspecting unit (not shown) or the like for inspecting a flying state of functional liquid droplets ejected from the functional liquid droplet ejection head 3 in addition to the both units 62 and 63.

Figure 5:
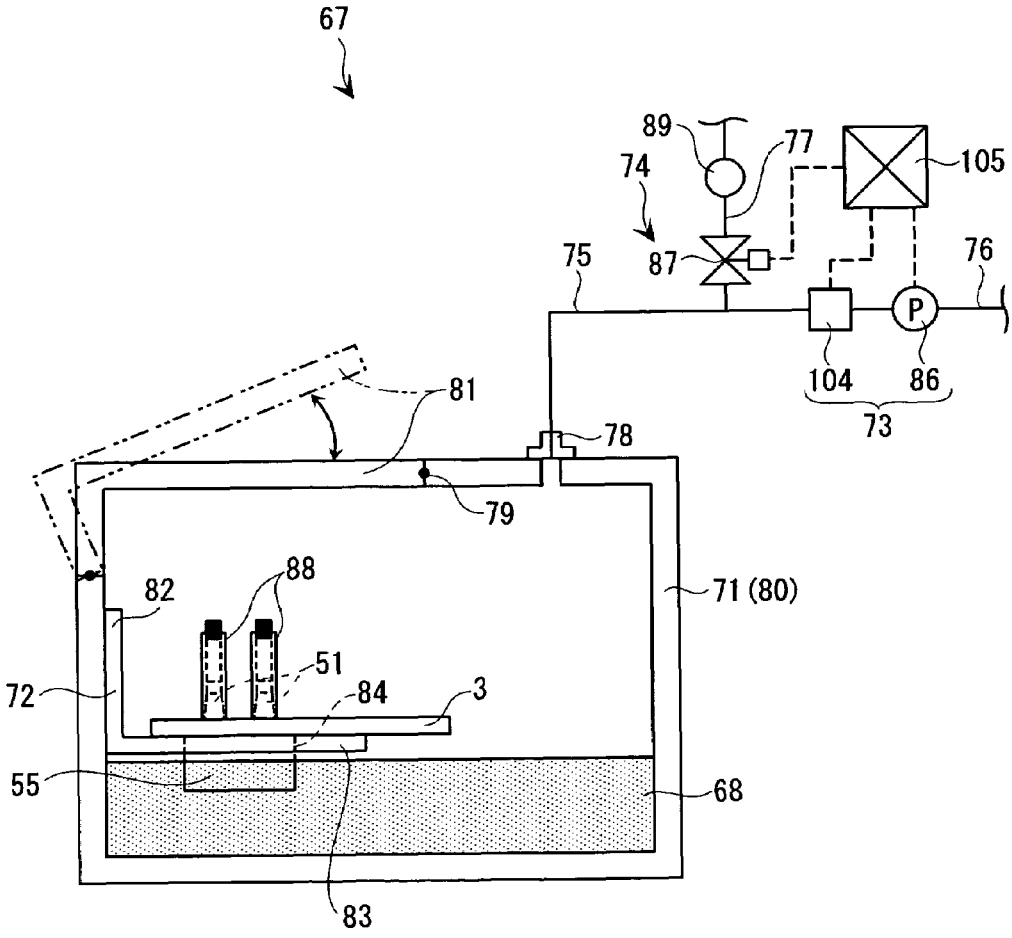
FIG. 5 is an initial filling apparatus according to a first embodiment.

Referring to FIG. 5, description will now be made about an initial filling method of a filling liquid for the functional liquid droplet ejection head 3 and an initial filling apparatus 67 used therefor. In the initial filling apparatus 67, the filling liquid 67 consisting essentially of a functional liquid or a solvent thereof is filled in the functional liquid droplet ejection head 3. Further, it is preferable that the initial filling apparatus 67 serve also as a head storing apparatus for storing the functional liquid droplet ejection head 3 as initially filled with a filling liquid.

The initial filling apparatus 67 has a sealed vessel 71 in which the filling liquid 68 is stored, a head supporting unit 72 for supporting the functional liquid droplet ejection head 3 in such a manner as to be immersed in the filling liquid 68, a pressure-reducing unit 73 for reducing pressure inside the sealed vessel 71, a pressure-restoring unit 74 for restoring (raising) the pressure inside the sealed vessel 71, and a controlling unit 105 for comprehensively controlling the units described above. In this case, the filling liquid 68 consists of the solvent of a functional liquid. Therefore, no deterioration occurs in the functional liquid even if it is mixed with the solvent.

The sealed vessel 71 is formed in a substantially quadrate shape and air-tightly and liquid-tightly made of a pressure-resistant and corrosion-resistant material such as a stainless steel. The sealed vessel 71 has a vessel main body 80 for storing the filling liquid 68 and an opening and closing lid 81 for closing the vessel main body 80 with a seal 79 interposed between the lid and the vessel main body. The vessel main body 80 has a predetermined amount of the filling liquids 68 stored therein. Furthermore, the functional liquid droplet ejection head 3 can be taken out or put in when the opening and closing lid 81 is opened.

Above the vessel main body 80 is an exhausting and air-supplying pipe 75 which is pipe-connected (communicated) to the pressure-reducing unit 73 and the pressure-restoring unit 74. The exhausting and air-supplying pipe 75 is branched into an exhaust branch pipe 76 communicating with the pressure-reducing unit 73 and an air-supplying branch pipe 77 communicating with the pressure-restoring unit 74. The exhausting and air-supplying pipe 75 is connected to the upper portion of the vessel main body 80 with a connection hardware 78 with its surrounding sealed, and air-tightness inside the sealed vessel 71 is maintained. Note that the vessel main body 80 may have a replenishment pipe for replenishing the filling liquid 68 in the vessel main body 80 connected thereto.

The pressure-reducing unit 73 is composed of a vacuum pump 86 and connected to the sealed vessel 71 through the exhaust-branch pipe 76. The exhaust branch pipe 76 is provided with a pressure sensor 104, and the pressure-reducing unit 73 is designed to keep set pressure (set degree of vacuum) inside the sealed vessel 71 between 1000 Pa and 100 Pa. On the other hand, the pressure-restoring unit 74 is composed of a regulator 89 communicating with dry-air supplying equipment (not shown) and an opening and closing valve 87 (electromagnetic valve). In other words, when the pressure-restoring unit 74 is switched to the communication mode, the sealed vessel 71 is supplied with dry air having pressure approximately the same as atmospheric pressure through the air-supplying branch pipe 77. As a result, the filling liquid 68 is prevented from getting mixed with humidity or the like in the pressure-restoring step as described below. Note that a nitrogen gas may be introduced to the sealed vessel in place of dry air.

The head supporting unit 72 has a vertical portion 82 which is fixed to the sealed vessel 71 and a seating portion 83 on which the functional liquid droplet ejection head 3 is seated, and is formed in a substantially "L"-shape as seen in cross section. The seating portion 83 has a through hole 84 provided therein for loosely-inserting the head main body 55 of the functional liquid droplet ejection head 3. The head main body 55 is set to the through hole 84 such that its lower end downwardly protrudes therefrom. The functional liquid droplet ejection head 3 supported by the head supporting unit 72 has the head main body 55 immersed in the filling liquid 68. Note that it is preferable that the vertical portion 82 be vertically slidable relative to the sealed vessel 71 and the height of the head supporting unit 72 be adjustable.

The controlling unit 105 controls the driving of the vacuum pump 86 of the pressure-reducing unit 73 and the opening and closing of the opening and closing valve 87 of the pressure-restoring unit 74. Furthermore, the controlling unit 105 is capable of feedback-controlling the pressure-reducing unit 73 based on results detected by the pressure sensor 104 and controlling the pressure inside the sealed vessel 71 to a predetermined degree.

Figure 6:
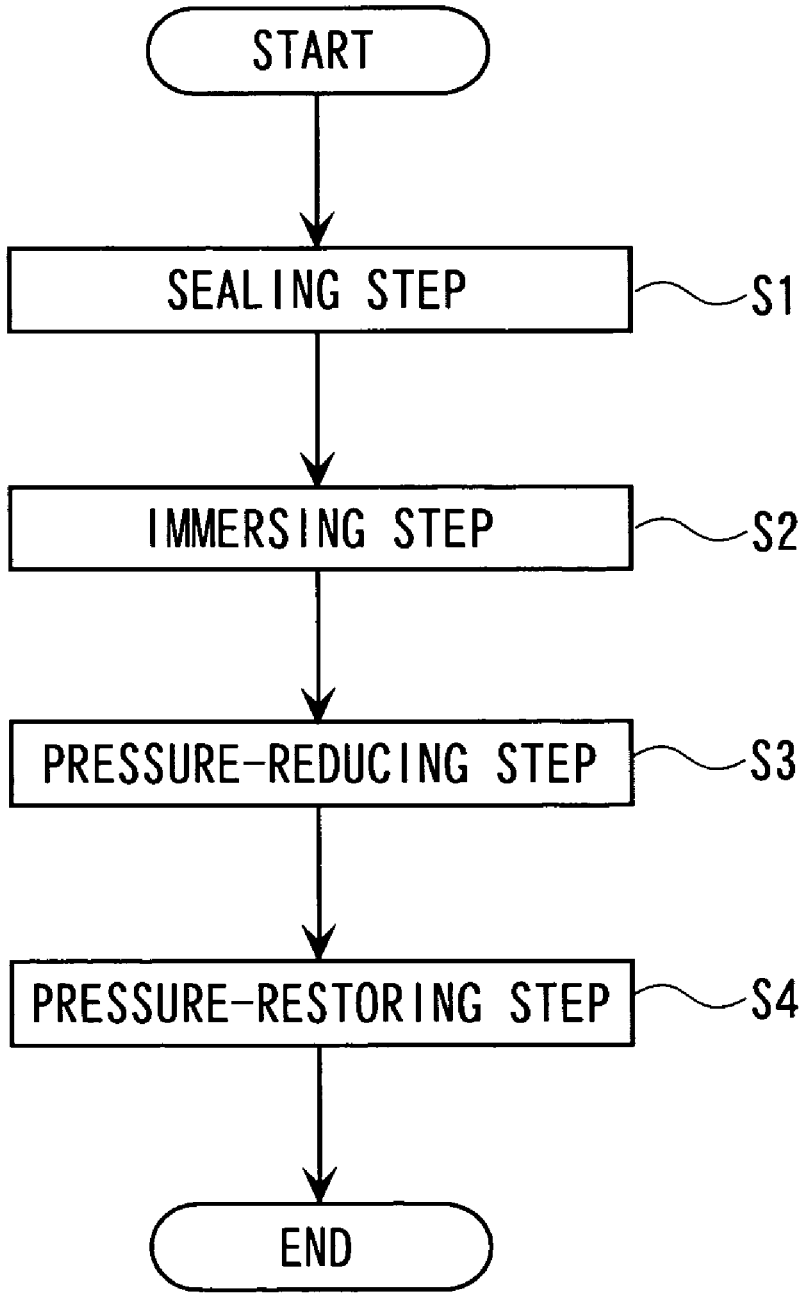
FIG. 6 is a flow chart of the initial filling apparatus of the first embodiment.

Referring next to FIG. 6, description will be made about an initial filling method for the functional liquid droplet ejection head 3 using the initial filling apparatus 67 described above. The initial filling method comprises a sealing step (S1) for sealing the connecting needles 51 (functional liquid introducing port), an immersing step (S2) of immersing the functional liquid droplet ejection head 3 in the filling liquid 68, a pressure-reducing step (S3) of reducing pressure inside the sealed vessel 71 to a predetermined degree of vacuum, and a pressure-restoring step (S4) of restoring (raising) the pressure inside the sealed vessel 71.

The sealing step (S1) is manually performed by an operator. In other words, a pair of the connecting needles 51 and 51 of the functional liquid droplet ejection head 3 are used to be connected to the functional liquid tube 34 when installed in the liquid droplet ejection apparatus 1, and the operator puts on the connecting needles 51 a pair of sealing members 88 and 88 (tubes with stoppers) having the same diameter as that of the functional liquid tube 34, to thereby seal the connecting needles 51 (see FIG. 5).

Subsequently, in the immersing step (S2), the operator opens the opening and closing lid 81 of the sealed vessel 71 and directly mounts on the head supporting unit 72 the functional liquid droplet ejection head 3 attached with the sealing members 88 described above. In this state, the lower end of the head main body 55 of the functional liquid droplet ejection head 3 is immersed in the filling liquid 68.

In the pressure-reducing step (S3), the pressure-reducing unit 73 is activated to exhaust the atmosphere inside the sealed vessel 71 and reduce pressure in the sealed vessel 71 to a predetermined degree of vacuum. The pressure-reducing step (S3) lasts for several hours in a state where the sealed vessel 71 maintains a predetermined degree of vacuum (i.e., value between 1000 Pa and 100 Pa) therein. More specifically, when a degree of vacuum is set to 400 Pa, the controlling unit 105 controls the driving of the pressure-reducing unit 73 as it feeds back the signals detected by the pressure sensor 104. According to the pressure-reducing step (S3) in which the degree of vacuum is set to 400 Pa, the degree of vacuum causing no volatilization in the filling liquid 68 is maintained, and the atmosphere inside the sealed vessel 71 and the gas dissolved in the filling liquid 68 are gradually exhausted (degassed). Furthermore, the atmosphere left in the passage 54 of the head is dissolved in the surrounding filling liquid 68 as the filling liquid 68 is degassed, thereby causing the passage 54 of the head to have the same degree of vacuum as that of the surrounding sealed vessel 71 when the pressure-reducing step (S3) ends.

Next, in the next pressure-restoring step (S4), the pressure-reducing unit 73 stops activating, and the opening and closing valve 87 of the pressure-restoring unit 74 is switched to the open mode to supply dry air to the inside of the sealed vessel 71 and cancel the vacuum therein. After the vacuum is canceled, the pressure inside the sealed vessel 71 rises, and the filling liquid 68 penetrates into the passage 54 of the functional liquid droplet ejection head 3. The passage 54 of the head is then completely filled with the filling liquid 68. As a result, the filling liquid 68 can be initially filled in the passage 54 of the head and the passage 54 is completely moistened with the filling liquid 68.

The functional liquid droplet ejection head 3 subjected to the initial filling in this manner is stored as it is or used immediately. When the functional liquid droplet ejection head 3 is used, the functional liquid droplet ejection head 3 which an operator manually collects from the sealed vessel 71 is mounted on the liquid droplet ejection apparatus 1 and sucked by the storage and suction unit 62. By this suction operation, the filling liquid 68 is removed from the functional liquid droplet ejection head, and a functional liquid is then supplied from the functional liquid tank 33 in place of the filling liquid 68 just removed. Although air sometimes intrudes into the connecting needles 51 of the functional liquid droplet ejection head 3, the passage 54 of the head is completely moistened with the filling liquid 68 as described above, thereby making it possible to fill the functional liquid in the passage 54 without having air bubbles left therein.

Note that, although the pressure-reducing step (S3) is performed after the immersing step (S2) in the present embodiment, the immersing step may be performed after the pressure-reducing step. According to this initial filling method, the passage 54 of the functional liquid droplet ejection head 3 is previously degassed and the immersing step is then performed, thereby making it possible to degas the passage 54 of the head in a short period of time. Furthermore, although dry air is to be introduced to the sealed vessel 71 in the pressure-restoring step, air may be alternatively introduced thereto depending on the type of a filling liquid involved.

According to the present embodiment, the functional liquid (filling liquid 68) is filled in the vacuum functional liquid droplet ejection head 3. As a result, the initial filling for the functional liquid droplet ejection head 3 can be properly performed without having air bubbles left at corners of the passage 54 of the head.

Figure 7:
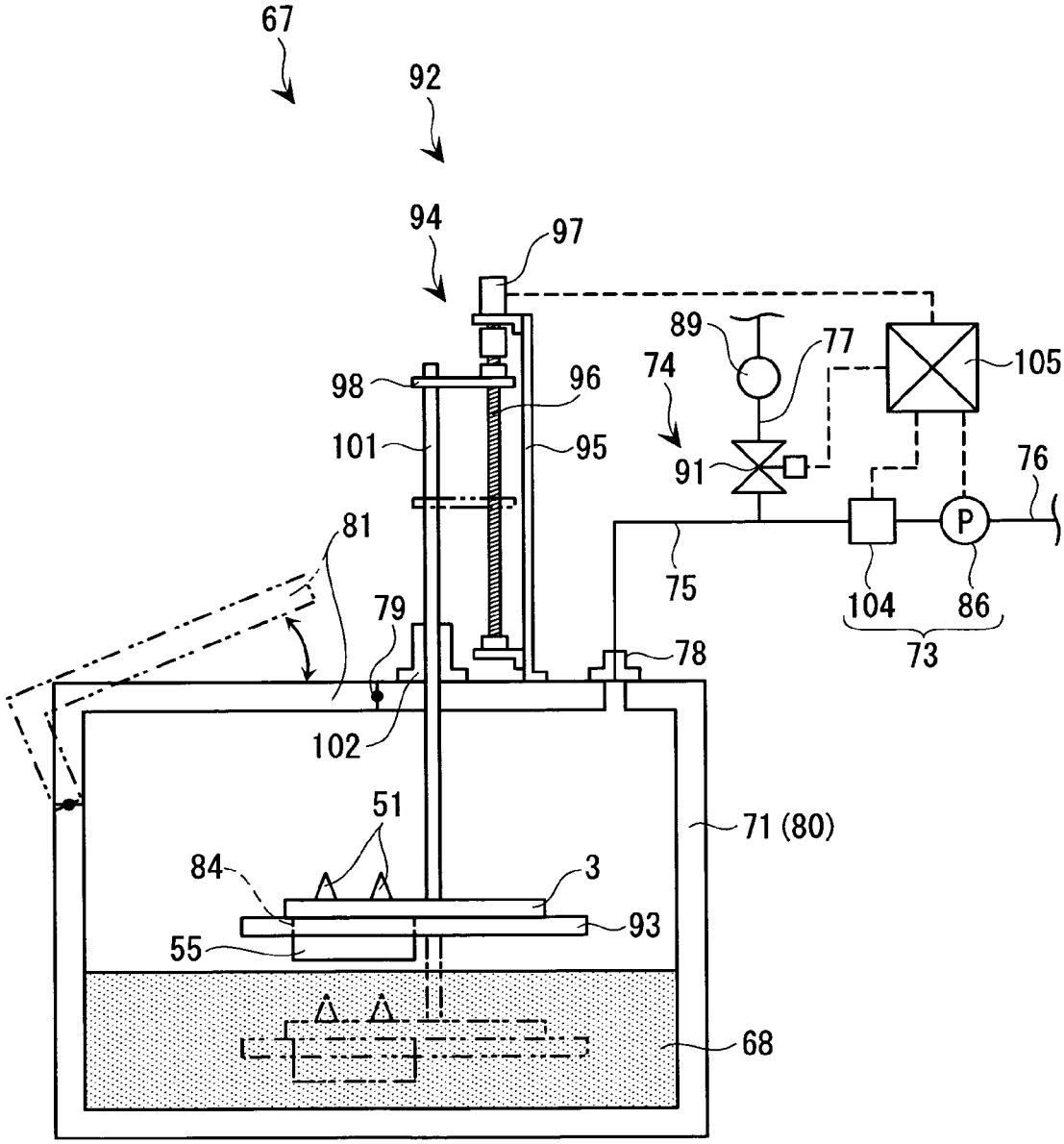
FIG. 7 is the initial filling apparatus according to a second embodiment.

Next, description will be made about a second embodiment of the initial filling apparatus focusing on those matters not involved in the initial filling apparatus 67 of the first embodiment. As shown in FIG. 7, the initial filling apparatus 67 of the second embodiment is composed of the sealed vessel 71 in which the filling liquid 68 is stored, the pressure-reducing unit 73 for reducing pressure inside the sealed vessel 71, an elevating unit 92 for immersing the head main body of the functional liquid droplet ejection head 3 in the filling liquid 68, the pressure-restoring unit 74 for restoring (raising) the pressure inside the sealed vessel 71, and the controlling unit 105 for comprehensively controlling the units described above.

The elevating unit 92 has a plate-shaped head supporting tool 93 and an elevating screw mechanism 94 for elevating the head supporting tool 93. The head supporting tool 93 has a through hole 84 provided therein for loosely inserting the head main body 55 of the functional liquid droplet ejection head 3. When the functional liquid droplet ejection head 3 is mounted on the head supporting tool 93, the lower end of the head main body 55 downwardly protrudes from the through hole 84.

The elevating screw mechanism 94 has a frame member 95 provided on the upper surface of the sealed vessel 71 in a standing manner, a lead screw 96 which is rotatably supported by the frame member 95, a motor 97 for rotating the lead screw 96, an elevating piece 98 with a female screw, which is threadedly engaged with the lead screw 96 and elevated, and a suspending rod 101 supported by the elevating piece 98 and having the head supporting tool 93 suspended at the lower end thereof. When the motor 97 is driven to rotate the lead screw 96 and move the suspending rod 101 (elevating piece 98) up and down, the head supporting tool 93 is elevated between an immersing position where the head supporting tool 93 is immersed in the filling liquid 68 and a pull-up position where the head supporting tool is pulled up from the filling liquid 68. Furthermore, at the portion where the suspending rod 101 contacts with the sealed vessel 71 is disposed a sealing member 102 for maintaining an air-tight state inside the sealed vessel 71.

The sealed vessel 71 is formed in a substantially quadrate shape and air-tightly and liquid-tightly made of a pressure-resistant and corrosion-resistant material such as a stainless steel as in the case of the first embodiment. Furthermore, the pressure-reducing unit 73 is composed of the vacuum pump 86 having the pressure sensor 104 interposed between the vacuum pump and the sealed vessel, and the pressure-restoring unit 74 is composed of the regulator 89 communicating with dry-air supplying equipment (not shown) and the opening and closing valve 91 (electromagnetic valve). The pressure-reducing unit 73 and the pressure-restoring unit 74 are composed in the same manner as that of the first embodiment. The controlling unit 105 controls the driving of the vacuum pump 86 and the opening and closing of the opening and closing valve 91, the detection of the degree of vacuum by the pressure sensor 104, and the driving of the motor 97 of the elevating unit 92.

Figure 8:
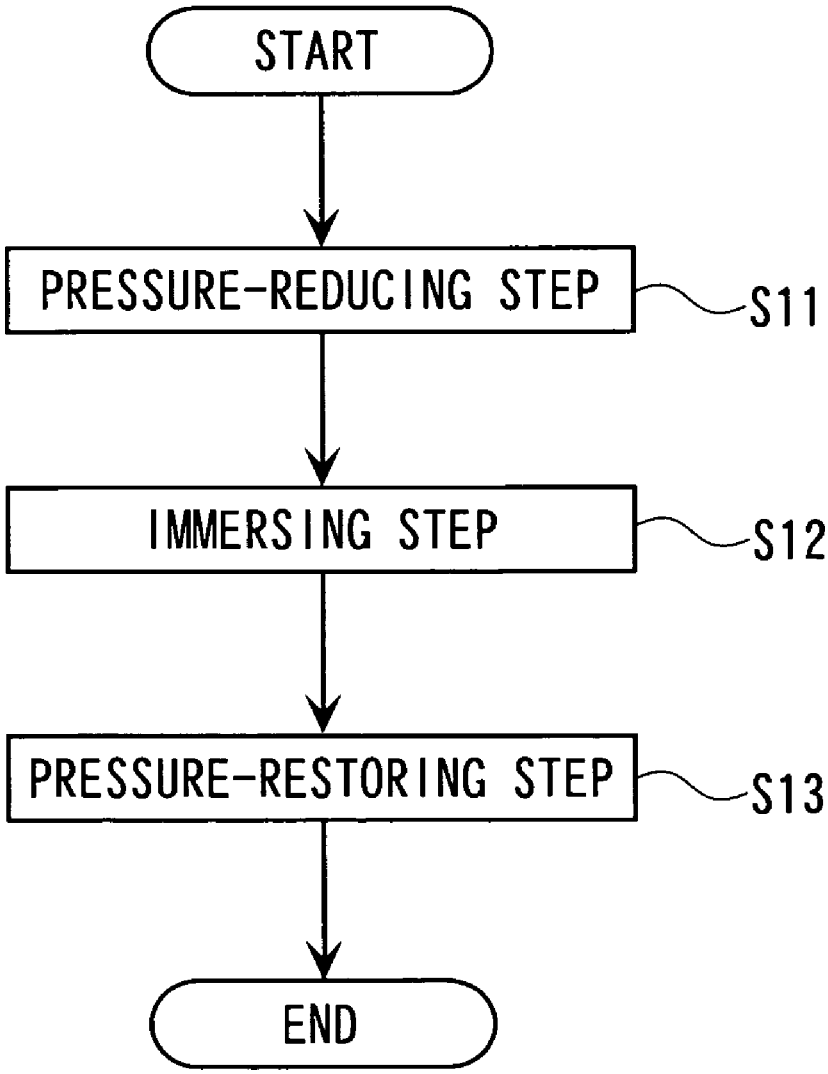
FIG. 8 is a flow chart of the initial filling apparatus of the second embodiment.

Next, description will be made about the initial filling method using the initial filling apparatus of the second embodiment. As shown in FIG. 8, the initial filling method of the second embodiment comprises the pressure-reducing step (S11), the immersing step (S12), and the pressure-restoring step (S13).

In the pressure-reducing step (S11), pressure inside the sealed vessel 71 is reduced. Prior to this step, the operator mounts the functional liquid droplet ejection head 3 on the elevating unit 92 (head supporting tool 93). In this case, the head supporting tool 93 is held by the elevating screw mechanism 94 at a position spaced from the filling liquid 68. When the operator closes the opening and closing lid 81 and instructs the controlling unit 105 to start an initial filling, the controlling unit 105 drives the pressure-reducing unit 73 and starts exhausting and reducing pressure inside the sealed vessel 71.

In the pressure-reducing step (S11), the pressure inside the sealed vessel 71 is reduced to a predetermined degree of vacuum (i.e., value between 1000 Pa and 100 Pa), and the atmosphere inside the sealed vessel including that present in the passage 54 of the functional liquid droplet ejection head 3 and the air dissolved in the filling liquid 68 are degassed.

When the pressure inside the sealed vessel 71 reaches the predetermined degree of vacuum in the pressure-reducing step (S11), the controlling unit 105, which has detected signals from the pressure sensor 104, drives the elevating unit 92 (motor 97) to start an immersing step (S12). The elevating unit 92 lowers to the immersing position the head supporting tool 93 having the functional liquid droplet ejection head 3 mounted thereon by means of the elevating screw mechanism 94 so that the functional liquid droplet ejection head 3 is immersed in the filling liquid 68 (i.e., the whole functional liquid droplet ejection head 3 is immersed in the filling liquid 68). The immersing step (S12) is performed for several hours in a state where the functional liquid droplet ejection head 3 is immersed in the filling liquid. In this case, since the passage 54 of the functional liquid droplet ejection head 3 is kept in vacuum before being immersed in the filling liquid, air bubbles hardly occur in the passage 54 of the head after the functional liquid droplet ejection head is immersed in the filling liquid. Furthermore, even if air bubbles occur in some cases, the degassing of the surrounding filling liquid 68 causes the air bubbles to be absorbed in the filling liquid 68. As a result, such air bubbles are prevented from being left until when the immersing step ends.

When the immersing step (S12) ends, the controlling unit 105 stops the pressure-reducing unit 73 and drives the pressure-restoring unit 74 to start the pressure-restoring step (S13). The pressure-restoring unit 74 supplies dry air (e.g., nitrogen gas) into the sealed vessel 71 to raise the pressure inside the sealed vessel 71. When the pressure inside the sealed vessel 71 is raised up to approximate atmospheric pressure, the controlling unit 105 drives the elevating unit 92 to pull up the head supporting tool 93 to the pull-up position. Under this state, the operator opens the opening and closing lid 81 to collect the functional liquid droplet ejection head 3 and mount the same on the liquid droplet ejection apparatus 1.

According to the initial filling method for the functional liquid droplet ejection head 3 of the second embodiment, since the functional liquid droplet ejection head 3 is completely immersed in the filling liquid 68 in the immersing step, air is prevented from being left in the functional liquid droplet ejection head 3. Furthermore, unlike in the first embodiment, it is not necessary to make preparations such as mounting of the sealing member 88. Note that link mechanism, rack-and-pinion steering, or the like may be used as the elevating unit 92.

Next, description will be made about a construction and a method of manufacturing, for example, a color filter, a liquid-crystal display (LCD), an organic EL (electro-luminescence) device, a plasma display panel (PDP device), an electron emission device (FED (field emission display) and SED (surface-conduction electron-emitter display)), and an active matrix substrate which is formed in the aforementioned display devices, as an electro-optic device (flat panel display) manufactured by the use of the liquid droplet ejection apparatus 1 of the present embodiment. Note that the active matrix substrate refers to a substrate having a thin film transistor, a source line electrically connected to the thin film transistor, and a data line formed therein.

Figure 9:
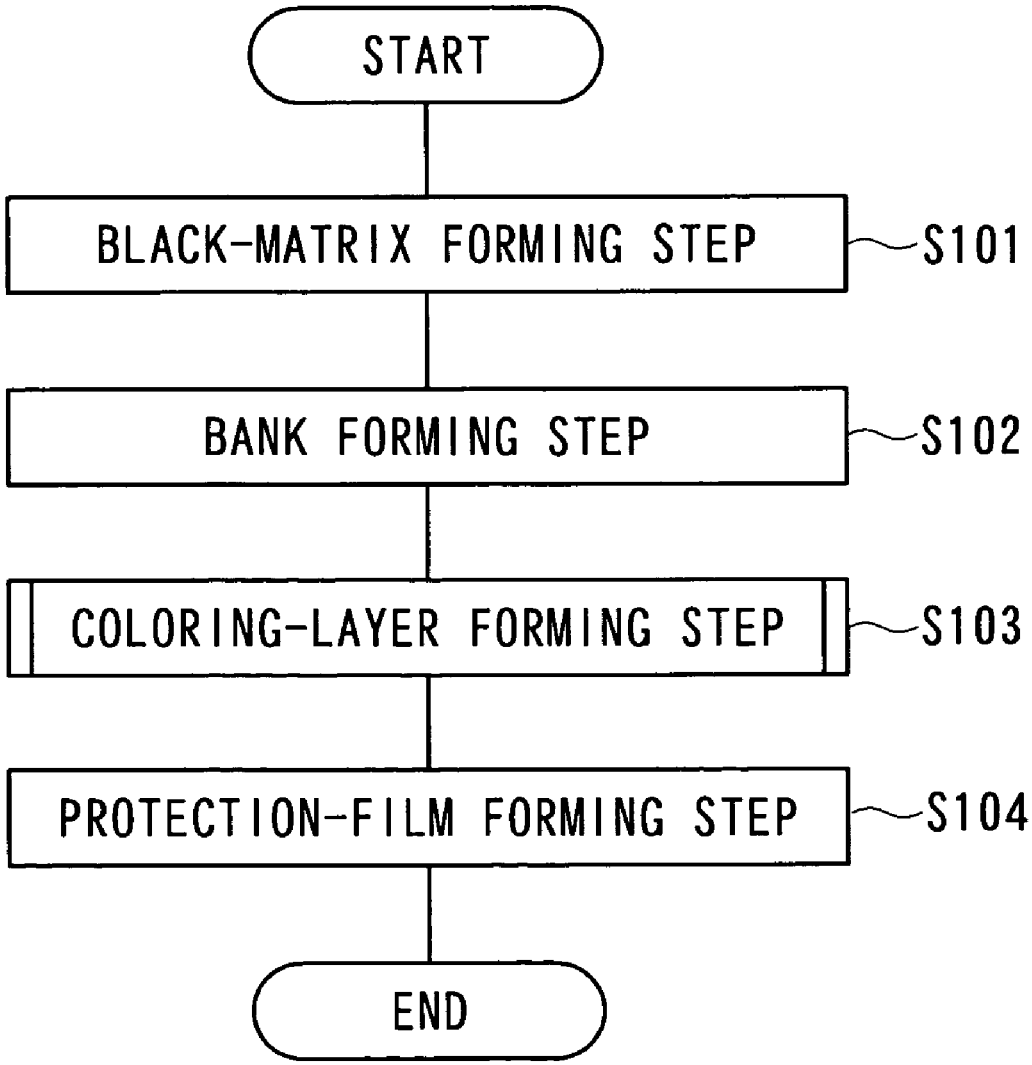
FIG. 9 is a flow chart explaining a step of manufacturing a color filter.

To begin with, description will be made about a method of manufacturing a color filter to be incorporated in a liquid-crystal display device, an organic EL device, or the like. FIG. 9 is a flow chart showing a process of manufacturing a color filter, and FIG. 10 is a schematic cross section of a color filter 500 (filter substrate 500A) of the present embodiment as shown in the order of the manufacturing process thereof.

Figure 10A:
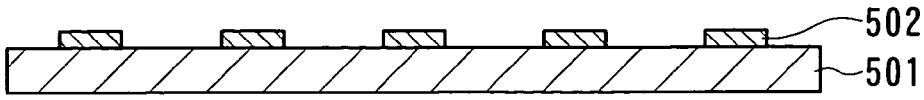
FIGS. 10A to 10E are schematic cross sections of the color filter as shown in the order of manufacturing the same.

First, in a black-matrix forming step (S101), a black matrix 502 is formed on a substrate (W) as shown in FIG. 10A. The black matrix 502 is made of a chromium metal, a laminated body of a chromium metal and a chromium oxide, a resin black, or the like. A sputtering method, a vapor deposition method, or the like can be used to form the black matrix 502 made of a metallic thin film. Furthermore, a gravure printing method, a photo-resist method, a thermal transfer method, or the like can be used to form the black matrix 502 made of a resin thin film.

Figure 10B:
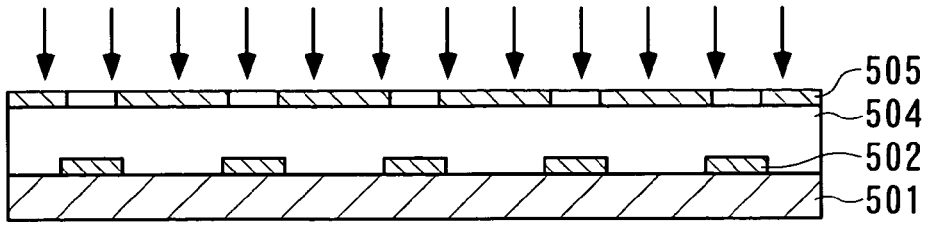

Subsequently, in a bank forming step (S102), a bank 503 is formed so as to superpose on the black matrix 502. In other words, as shown in FIG. 10B, a resist layer 504 made of a negative transparent photosensitive resin is formed to cover the substrate 501 and the black matrix 502. Then, an exposure process is performed on the top surface of the resist layer in a state of being covered by a mask film 505 formed in a matrix pattern.

Figure 10C:
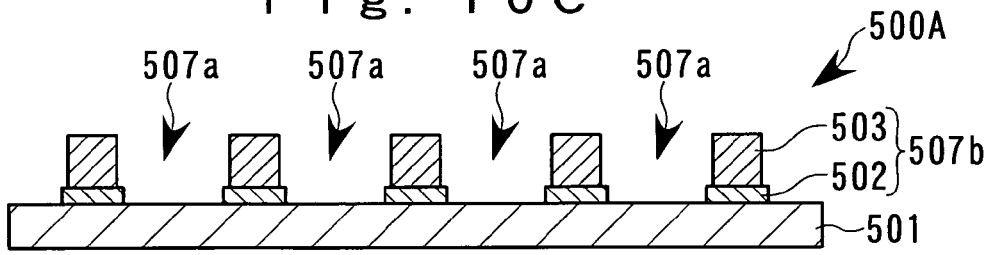

Moreover, as shown in FIG. 10C, an unexposed portion of the resist layer 504 is etched to pattern the resist layer 504, thereby forming the bank 503. Note that, when the black matrix is formed of a resin black, it is possible that the black matrix serves also as the bank.

The bank 503 and the black matrix 502 thereunder serve as a partition wall portion 507*b* for partitioning respective pixel regions 507*a* and define shooting positions of functional liquid droplets when coloring layers (film-deposited portions) 508R, 508G, and 508B are formed with the functional liquid droplet ejection heads 3 in a coloring-layer forming step as described later.

According to the black-matrix forming step and the bank forming step as described above, the filter substrate 500A can be obtained.

Note that, in the present embodiment, a resin material is used as a material of the bank 503 so as to have a lyophobic (hydrophobic) surface of a coating film. The front surface of the substrate (glass substrate) 501 is lyophilic (hydrophilic), thereby enhancing the positional accuracy for shooting liquid droplets into the respective pixel regions 507*a* surrounded by the banks 503 (partition wall portions 507*b*) in a coloring-layer forming step as described later.

Figure 10D:
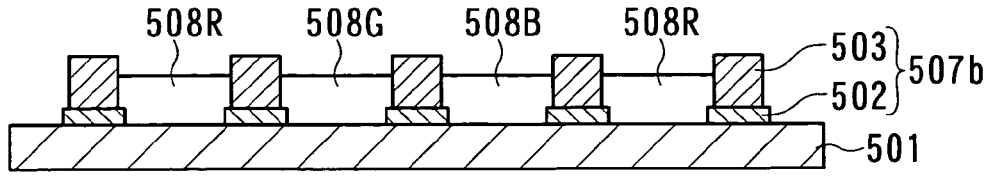

Next, in the coloring-layer forming step (S103), functional liquid droplets are ejected by the functional liquid droplet ejection heads 3 and shot into the respective pixel regions 507*a* surrounded by the partition wall portions 507*b* as shown in FIG. 10D. In this case, a functional liquid (filter material) of three colors of R (red), G (green), and B (blue) is introduced by the functional liquid droplet ejection heads 3 to eject functional liquid droplets. Note that examples of arrangement patterns for the three colors of R, G, and B include a strip arrangement, a mosaic arrangement, a delta arrangement, or the like.

Figure 10E:
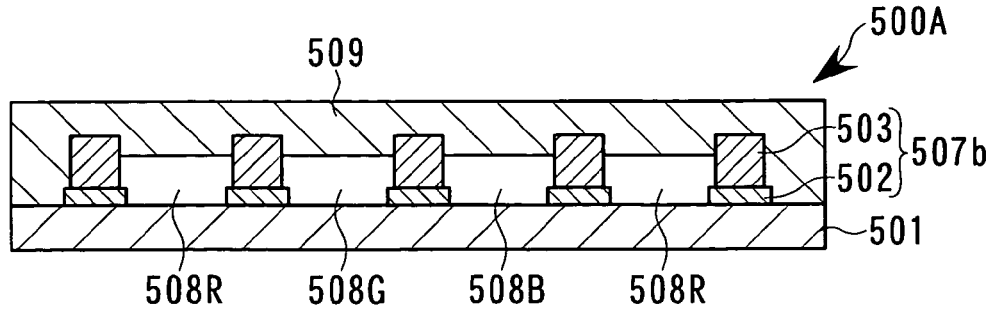

Subsequently, the functional liquids are subjected to drying treatment (e.g., thermal treatment) so as to be fixed, and the coloring layers 508R, 508G, and 508B of the three colors are formed. After the coloring layers of 508R, 508G, and 508B are formed, the step is moved to a protection-film forming step (S104) where a protection film 509 is formed to cover the top surfaces of the substrate 501, the partition wall portions 507*b*, and the coloring layers 508R, 508G, and 508B as shown in FIG. 10E.

In other words, after a coating liquid for a protection film is ejected on the whole surface of the substrate 501 having the coloring layers 508R, 508G, 508B formed thereon, the whole surface is subjected to drying treatment to thereby form the protection film 509.

After the protection film 509 is formed, the step is moved to the next step of forming ITO (Indium Tin Oxide) as a transparent electrode in manufacturing the color filter 500.

Figure 11:
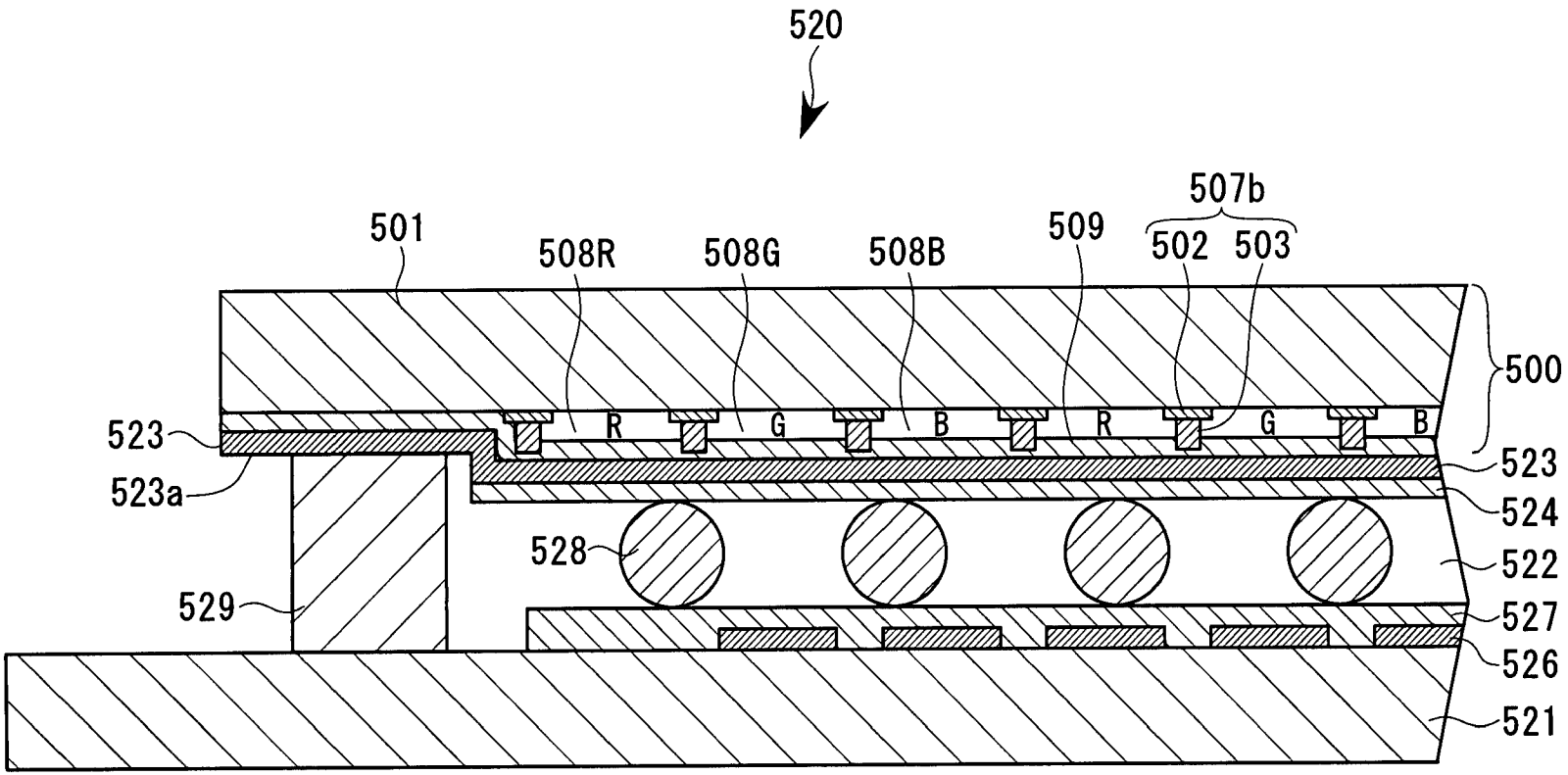
FIG. 11 is a cross section of an essential part showing a schematic configuration of a liquid crystal device using the color filter to which the invention is applied.

FIG. 11 is a cross section of an essential part showing a schematic configuration of a passive matrix liquid crystal display (liquid crystal device) as an example of an LCD using the color filter 500 as described above. It is made possible to obtain a transmission liquid crystal display as a final product by mounting additional elements such as a liquid crystal driving IC, a backlight, a supporting body on a liquid crystal device 520. Note that this color filter 500 is identical with that shown in FIG. 10. Thus, the corresponding portions are denoted by the same reference numerals, but the description thereof will be omitted.

The liquid display device 520 is roughly composed of the color filter 500, a counter substrate 521 made of a glass substrate or the like, and a liquid crystal layer 522 which is made of an STN (Super Twisted Nematic) liquid crystal composition and held between the color filter and the counter substrate. The color filter 500 is arranged on the upper side of the figure (on the observer's side).

Note that, although not shown in the figure, polarizers are each disposed on the outside surfaces of the counter substrate 521 and the color filter 500 (the surfaces opposite to the liquid crystal layer 522 side), and the backlight is disposed on the outside of the polarizer arranged on the counter substrate 521 side.

On the protection film 509 of the color filter 500 (liquid crystal layer side), a plurality of elongated first electrodes 523 in a strip shape are formed in the longitudinal direction at predetermined intervals as shown in FIG. 11. A first alignment layer 524 is formed to cover the surfaces opposite to the color filter 500 side of the first electrodes 523.

On the other hand, on the surface of the counter substrate 521 opposite to the color filter 500, a plurality of elongated second electrodes 526 in a strip shape are formed in the direction orthogonal to the first electrodes 523 of the color filter 500 at predetermined intervals. A second alignment layer 527 is formed to cover the surfaces of the liquid crystal layer 522 side of the second electrodes 526. The first electrodes 523 and the second electrodes 526 are made of a transparent conductive material such as ITO.

Spacers 528 provided in the liquid crystal layer 522 are members for holding a constant thickness (cell gap) of the liquid crystal layer 522. Furthermore, a sealant 529 is a member for preventing a liquid crystal composition of the liquid crystal layer 522 from leaking outside. Note that one end portion of each of the first electrode 523 extends to the outside of the sealant 529 as a routing wire 523*a*.

Areas where the first electrodes 523 and the second electrodes 526 cross each other are pixels at which the coloring layers 508R, 508G, and 508B of the color filter 500 are to be positioned.

According to the conventional manufacturing process, the color filter 500 side is formed in such a way that the first electrodes 523 are patterned and the first alignment layer 524 is coated on the color filter 500, while the counter substrate 521 side is formed in such a way that the second electrodes 526 are patterned and the second alignment layer 527 is coated on the counter substrate 521. Subsequently, the spacers 528 and the sealant 529 are formed on the counter substrate 521 side and bonded to the color filter 500 side. Next, after liquid crystal constituting the liquid crystal layer 522 is filled in from an inlet of the sealant 529, the inlet is closed. Then, both polarizers and the backlight are deposited.

According to the liquid droplet ejection apparatus 1 of the embodiment, it is, for example, possible to coat a spacer material (functional liquid) constituting the cell gap and evenly coat liquid crystal (functional liquid) in the region surrounded by the sealant 529 before the color filter 500 side is bonded to the counter substrate 521 side. It is further possible to perform printing of the sealant 529 with the functional liquid droplet ejection heads 3. In addition, it is possible to coat the first and second alignment layers 524 and 527 with the functional liquid droplet ejection heads 3.

Figure 12:
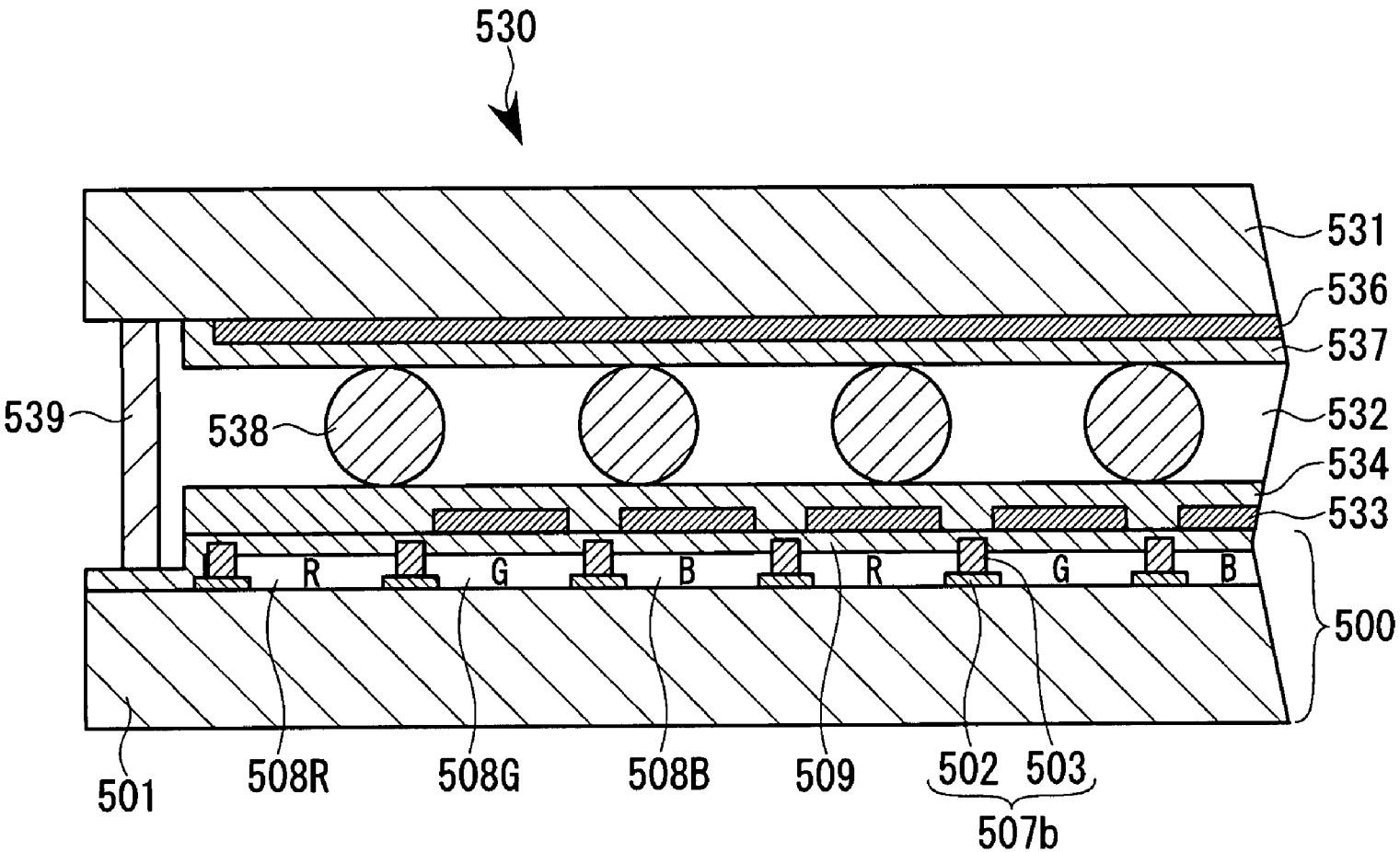
FIG. 12 is a cross section of an essential part showing a schematic configuration of a liquid crystal device as a second example using the color filter to which the invention is applied.

FIG. 12 is a cross section of an essential part showing a schematic configuration of a liquid crystal device, as a second example, using the color filter 500 manufactured in the present embodiment.

The liquid crystal device 530 is greatly different from the liquid crystal device 520 in that the color filter 500 is arranged on the lower side of the figure (the side opposite to the observer's side).

The liquid display device 530 is roughly composed of the color filter 500, a counter substrate 531 made of a glass substrate or the like, and a liquid crystal layer 532 made of an STN liquid crystal composition and held between the color filter and the counter substrate. Note that, although not shown in the figure, polarizers or the like are each disposed on the outside surfaces of the counter substrate 531 and the color filter 500.

On the protection film 509 of the color filter 500 (liquid crystal layer 532 side), a plurality of elongated first electrodes 533 in a strip shape extending in the direction orthogonal to the figure are formed at predetermined intervals. A first alignment layer 534 is formed to cover the surfaces on the liquid crystal layer 532 side of the first electrodes 533.

On the surface of the counter substrate 531 opposite to the color filter 500, a plurality of elongated second electrodes 536 in a strip shape extending in the direction orthogonal to the first electrodes 533 on the color filter 500 side are formed at predetermined intervals. A second alignment layer 537 is formed to cover the surfaces of the liquid crystal layer 532 side of the second electrodes 526.

The liquid crystal layer 532 has provided therein spacers 538 for holding a constant thickness of the liquid crystal layer 532 and a sealant 539 for preventing a liquid crystal composition in the liquid crystal layer 532 from leaking outside.

In the same manner as that of the liquid crystal device 520, areas where the first electrodes 533 and the second electrodes 536 cross each other are pixels at which the coloring layers 508R, 508G, and 508B of the color filter 500 are to be positioned.

Figure 13:
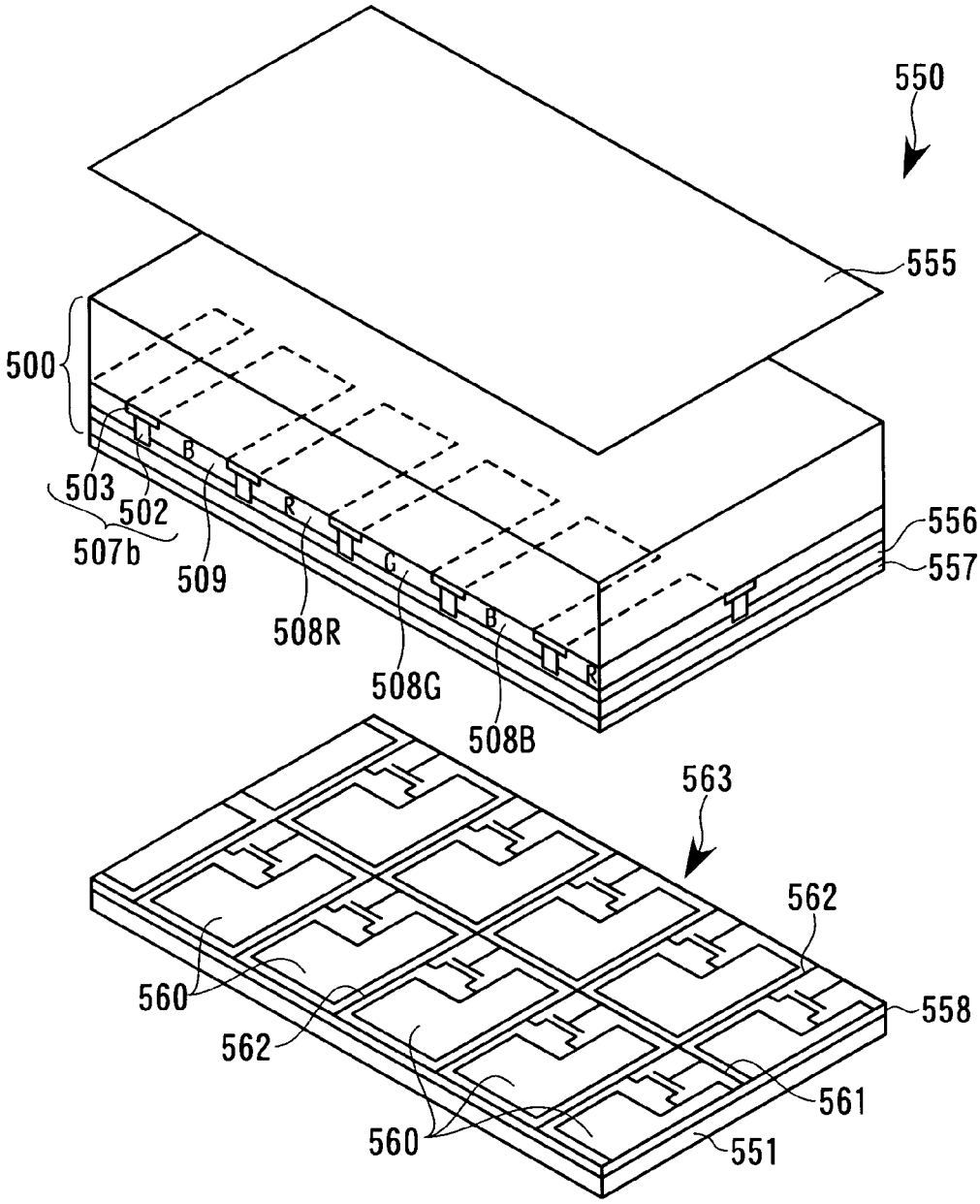
FIG. 13 is a cross section of an essential part showing a schematic configuration of a liquid crystal device as a third example using the color filter to which the invention is applied.

FIG. 13 shows a third example in which a liquid crystal device is constituted by the use of the color filter 500 to which the invention is applied and is an exploded perspective view showing a schematic configuration of a transmission TFT (Thin Film Transistor) liquid crystal device.

In the liquid crystal device 550, the color filter 500 is arranged on the upper side of the figure (on the observer's side).

The liquid crystal device 550 is roughly composed of the color filter 500, a counter substrate 551 disposed so as to oppose the color filter, a liquid crystal layer held between the color filter and the counter substrate (not shown), a polarizer 555 disposed on the top surface side of the color filter 500 (observer's side), and a polarizer (not shown) disposed on the bottom surface side of the counter substrate 551.

On the front surface of the protection film 509 of the color filter 500 (the surface on the counter substrate 551 side) is formed electrodes 556 for driving liquid crystal. The electrodes 556 are made of a transparent conductive material such as ITO and serves as the whole electrode covering the whole region in which the later-mentioned pixel electrodes 560 are formed. Furthermore, an alignment layer 557 is disposed in such a way as to cover the surfaces of the electrodes 556 opposite to the pixel electrodes 560 side.

The counter substrate 551 has an insulating layer 558 formed on the surface thereof opposite to the color filter 500. On the insulating layer 558 are formed scanning lines 561 and signal lines 562 in such a way that they directly cross each other. In regions surrounded by the scanning lines 561 and the signal lines 562 are formed pixel electrodes 560. Note that, although an alignment layer is disposed on the pixel electrodes 560 in an actual liquid crystal devices, it is omitted in the figure.

Furthermore, in the portion surrounded by a notch of the pixel electrode 560, each of the scanning lines 561, and each of the signal lines 562 is incorporated a thin film transistor 563 including a source electrode, a drain electrode, a semiconductor, and a gate electrode. It is possible, by applying signals to the scanning lines 561 and the signal lines 562, to turn on or off the thin film transistor 563 so as to perform an energizing control on the pixel electrodes 560.

Note that, although the liquid crystal devices 520, 530, and 550 of the respective examples as described above are of a transmission type, it is also possible to employ a liquid crystal device of a reflective type or a semi-transparent reflective type by providing a reflective layer or a semi-transparent reflective layer therein.

Figure 14:
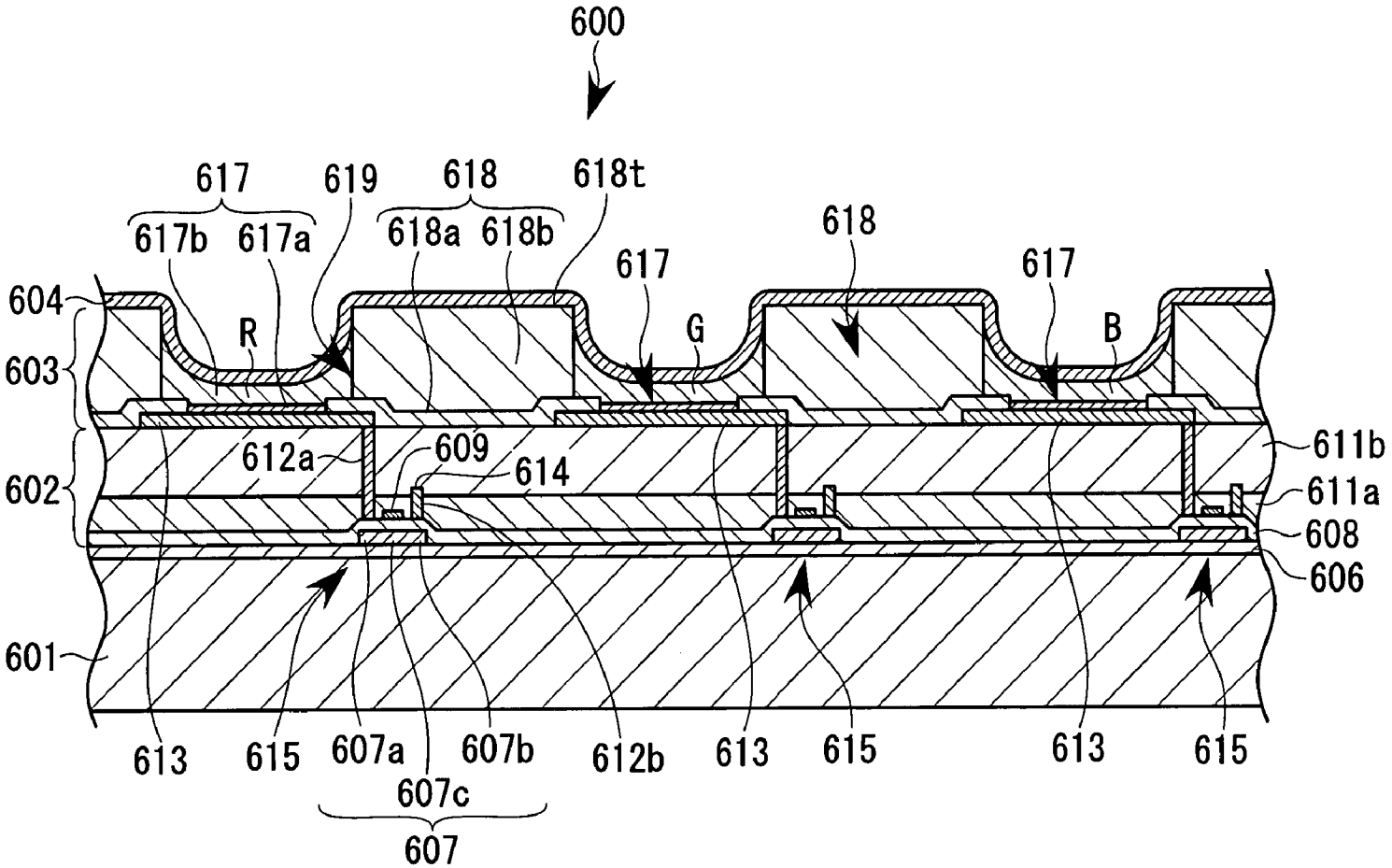
FIG. 14 is a cross section of an essential part of a display device as an organic EL device.

Next, FIG. 14 is a cross section of an essential part of a display region of an organic EL device (hereinafter, simply referred to as a display device 600).

The display device 600 has a rough configuration in which a circuit element portion 602, a light-emitting element portion 603, and a cathode 604 are laminated on a substrate (W) 601.

In the display device 600, light emitted from the light-emitting element portion 603 to the substrate 601 side passes through the circuit element portion 602 and the substrate 601 and is emitted to the observer's side, while light emitted from the light-emitting element portion 603 to the side opposite to the substrate 601 is reflected by the cathode 604, then passes through the circuit element portion 602 and the substrate 601, and is emitted to the observer's side.

The circuit element portion 602 and the substrate 601 have a base protection film 606 made of a silicone oxide film formed therebetween. The base protection film 606 (light-emitting element portion 603 side) has island-shaped semiconductor films 607 made of polycrystalline silicone formed thereon. In the left and right regions of the semiconductor films 607, highly concentrated cations are implanted so as to form a source region 607*a* and a drain region 607*b*, respectively. The central portion where no cations are implanted serves as a channel region 607*c*.

Furthermore, the circuit element portion 602 has a transparent gate insulation film 608 covering the base protection film 606 and the semiconductor film 607 formed thereon. At the positions corresponding to the channel regions 607*c* of the semiconductor film 607 on the gate insulation film 608 are formed gate electrodes 609 constituted of Al, Mo, Ta, Ti, W, or the like. The gate electrodes 609 and the gate insulation film 608 have first and second transparent interlayer insulation films 611*a* and 611*b* formed thereon. Furthermore, contact holes 612*a* and 612*b* are formed in such a way as to penetrate the first and second interlayer insulation films 611*a* and 611*b* and communicate with the source region 607*a* and the drain region 607*b* of the semiconductor film 607, respectively.

The second interlayer insulation film 611*b* has transparent pixel electrodes 613 made ITO or the like formed thereon in a predetermined pattern, and each of the pixel electrodes 613 is connected to the source region 607*a* via the contact hole 612*a*.

Furthermore, the first interlayer insulation film 611*a* has a power source line 614 disposed thereon. The power source line 614 is connected to the drain region 607*b* via the contact hole 612*b*.

As described above, the circuit element portion 602 has driving thin film transistors 615 connected to the respective pixel electrodes 613 formed therein.

The light-emitting element portion 603 is roughly constituted of functional layers 617 laminated on a plurality of pixel electrodes 613 and bank portions 618 which are provided between sets of the respective pixel electrodes 613 and the functional layers 617 so as to partition the respective functional layers 617.

A light-emitting element is composed of the pixel electrodes 613, the functional layers 617, and the cathode 604 disposed on the functional layers 617. Note that the pixel electrodes 613 are patterned in a substantially rectangular shape in plan view, and the bank portions 618 are formed between the respective pixel electrodes 613.

Each of the bank portions 618 is composed of an inorganic bank layer 618*a* (first bank layer) made of an inorganic material such as SiO, $SiO_2$, or $TiO_2$ and an organic bank layer 618*b* (second bank layer) laminated on the inorganic bank layer 618*a* and is made of a resist such as an acryl resin resist or a polyimide resin resist excellent in thermal resistance and solvent resistance, having a trapezoidal shape in cross section. A part of the bank portion 618 overlies the periphery of the respective pixel electrodes 613.

The respective bank portions 618 have an opening portion 619 formed therebetween, formed to be gradually enlarged upward relative to the pixel electrodes 613.

Each of the functional layers 617 is composed of a hole-injecting/transporting layer 617*a* and a light-emitting layer 617*b* formed on the hole-injecting/transporting layer 617*a*, both lying on the pixel electrode 613 of the opening portion in a laminated state. Note that another functional layer having any other function may be additionally formed, lying adjacent to the light-emitting layer 617*b*. For example, it is possible to form an electron-transporting layer.

The hole-injecting/transporting layer 617*a* serves to transport holes from the pixel electrode 613 side and inject the same into the light-emitting layer 617*b*. The hole-injecting/transporting layer 617*a* is formed after a first composition (functional liquid) containing a material for forming a hole-injecting/transporting layer is ejected. A publicly known material is used as the material for forming a hole-injecting/transporting layer.

The light-emitting layer 617*b* emits light of any one of the colors red (R), green (G), and blue (B) and is formed after a second composition (functional liquid) containing a material for forming a light-emitting layer (light-emitting material) is ejected. It is preferable that a publicly known material insoluble to the hole-injecting/transporting layer 617*a* be used as a solvent of the second composition (nonpolar solvent). Such a nonpolar solvent is used as the second composition of the light-emitting layer 617, thereby making it possible to form the light-emitting layer 617*b* without dissolving the hole-injecting/transporting layer 617*a* again.

According to this configuration, holes injected from the hole-injecting/transporting layer 617*a* and electrons injected from the cathode 614 are reunited so as to emit light in the light-emitting layer 617*b*.

The cathode 604 is formed so as to cover the whole light-emitting element portion 603 and plays an role of passing an electric current to the functional layer 617 together with the pixel electrode 613 as a pair. Note that the cathode 604 has a sealing member (not shown) arranged thereabove.

Referring next to FIGS. 15 to 23, description will be made about a process of manufacturing the display device 600.

Figure 15:
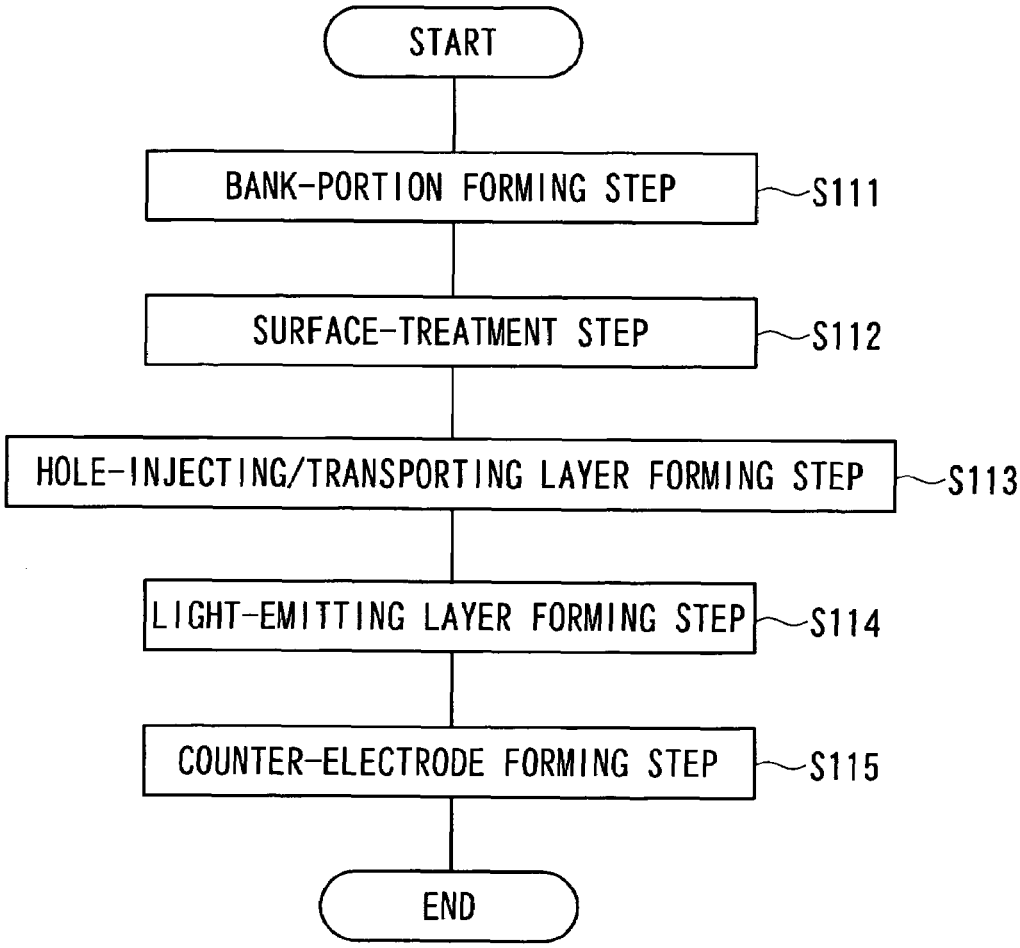
FIG. 15 is a flow chart explaining a step of manufacturing the display device as an organic EL device.

As shown in FIG. 15, the display device 600 is manufactured by way of a bank-portion forming step (S111), a surface-treatment step (S112), a hole-injecting/transporting layer forming step (S113), a light-emitting layer forming step (S114), and an counter-electrode forming step (S115). Note that the manufacturing process is not limited to that exemplified in the figure, and some steps may be deleted from or added to the process as required.

Figure 16:
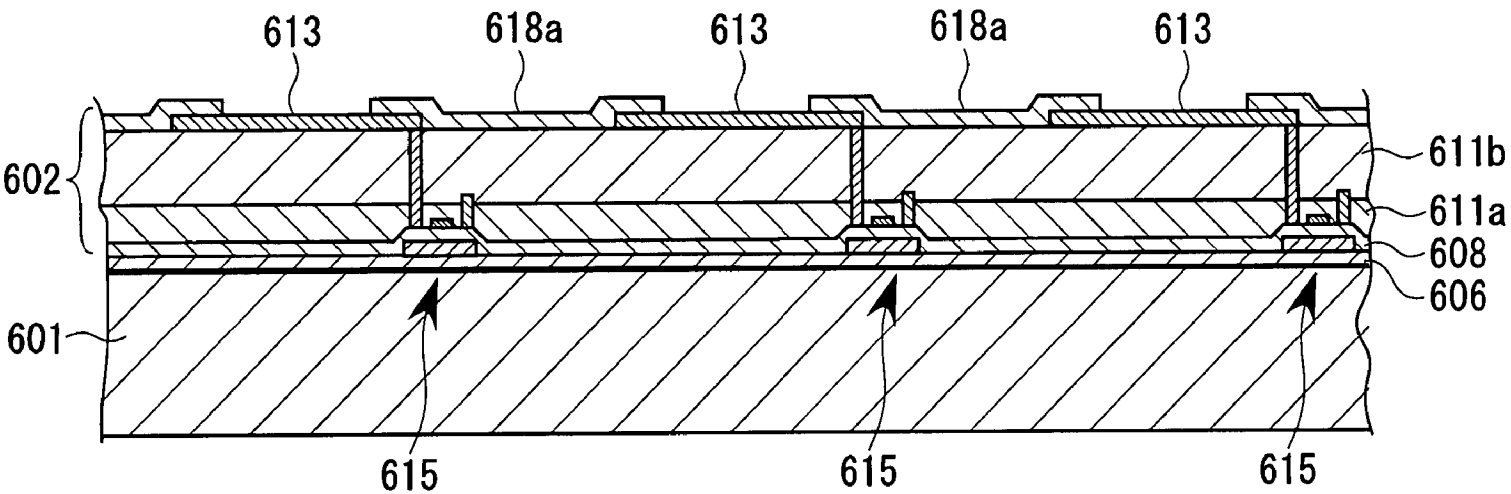
FIG. 16 is a process drawing explaining the formation of an inorganic bank layer.

First, as shown in FIG. 16, the inorganic bank layer 618*a* is formed on the second interlayer insulation film 611*b* in the bank-portion forming step (S111). The inorganic bank layer 618*a* is formed after an inorganic film is formed at its forming position and is then patterned by a photolithographic process or the like. At this time, a part of the inorganic bank layer 618*a* is formed so as to overlap with the periphery of the pixel electrode 613.

Figure 17:
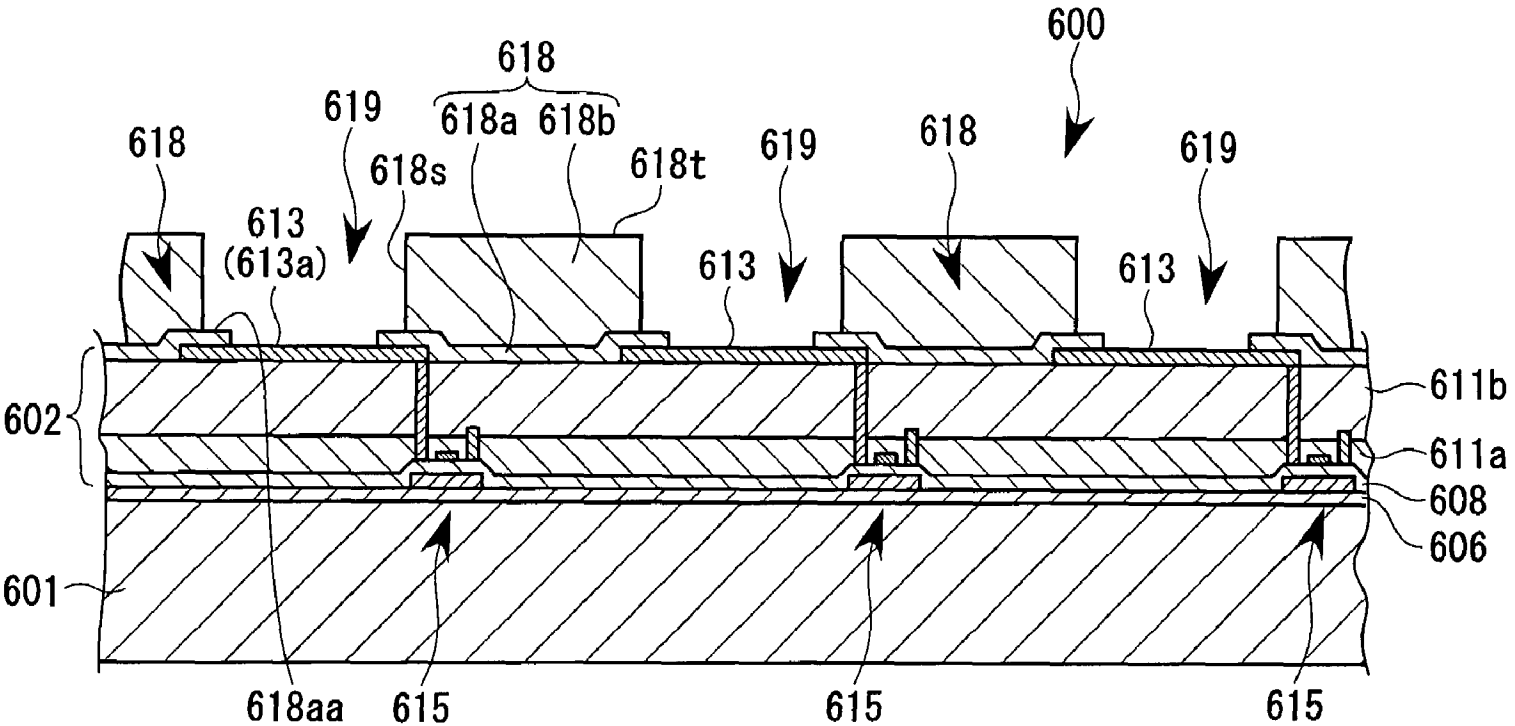
FIG. 17 is a process drawing explaining the formation of an organic bank layer.

After the inorganic bank layer 618*a* is formed, the organic bank layer 618*b* is formed on the inorganic bank layer 618*a* as shown in FIG. 17. The organic bank layer 618*b* is also patterned by the photolithographic process or the like in the same manner as that of the inorganic bank layer 618*a*.

The bank portion 618 is thus formed. In accordance with the formation of the bank, the respective bank portions 618 have the opening portion 619 formed therebetween so as to be opened upward relative to the pixel electrodes 613. The opening portion 619 serves to define a pixel region.

In the surface-treatment step (S112), lyophilic and liquid-repellent treatments are performed. The lyophilic treatment is applied to the regions of a first lamination portion 618*aa* of the inorganic bank layer 618*a* and an electrode surface 613*a* of the pixel electrode 613, and the regions are surface-treated so as to be lyophilic with plasma treatment using, for example, oxygen as a process gas. The plasma treatment serves also to clean ITO constituting the pixel electrode 613.

Furthermore, the liquid-repellent treatment is applied to wall surfaces 618*s* and the top surface 618*t* of the organic bank layer 618*b*, and the surfaces are fluoridized (treated so as to be liquid-repellent) with plasma treatment using, for example, tetrafluoromethane as a process gas.

As a result of the surface treatment step, it is possible to reliably shoot functional liquid droplets into pixel regions when the functional layer 617 is formed with the functional liquid droplet ejection head 3 and prevent the functional liquids shot into the pixel regions from leaking out of the opening portion 619.

According to the above-described steps, a display device substrate 600A can be obtained. The display device substrate 600A is mounted on the set table 17 of the liquid droplet ejection apparatus 1 as shown in FIG. 1, and the following hole-injecting/transporting layer forming step (S113) and the light-emitting layer forming step (S114) are hereinafter performed.

Figure 18:
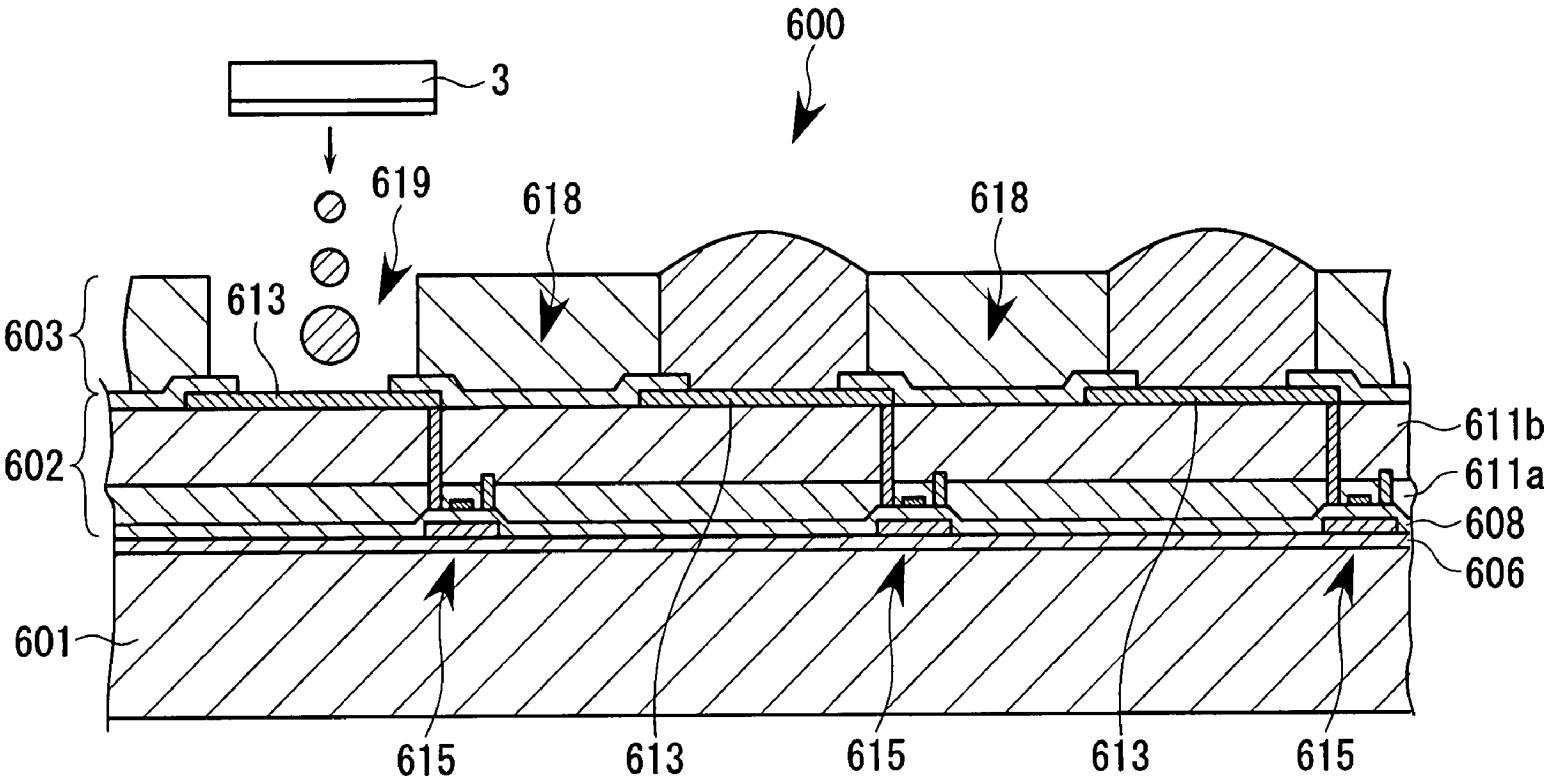
FIG. 18 is a process drawing explaining a step of forming a hole-injecting/transporting layer.
Figure 19:
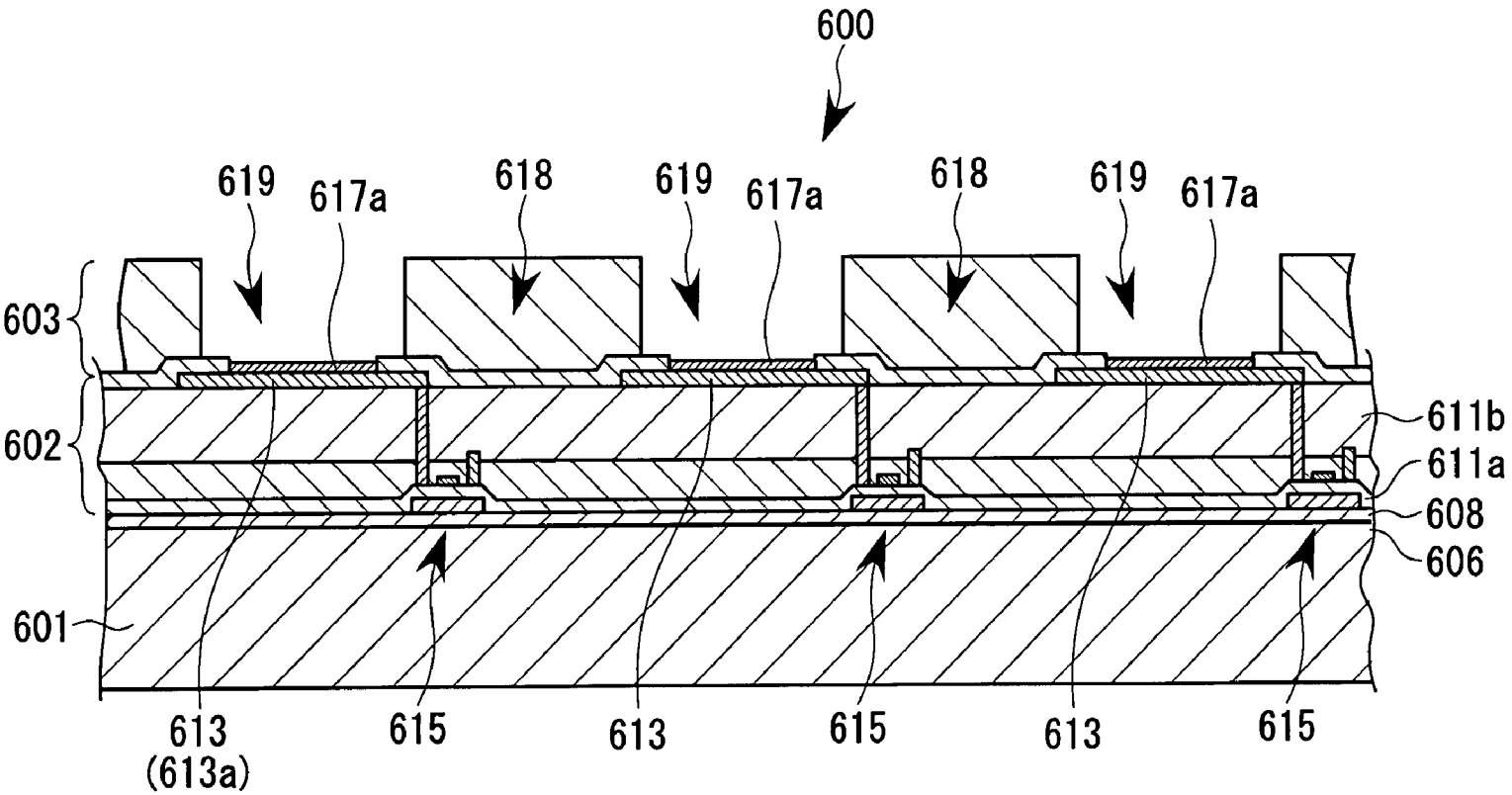
FIG. 19 is a process drawing explaining a state where the hole-injecting/transporting layer is formed.

As shown in FIG. 18, in the hole-injecting/transporting layer forming step (S113), the functional liquid droplet ejection head 41 ejects the first composition containing the hole-injecting/transporting layer forming material in the corresponding opening portion 619 as a pixel region. Subsequently, drying treatment and thermal treatment are performed on the first composition so as to evaporate a polar solvent contained therein and form the hole-injecting/transporting layer 617*a* on the pixel electrode (electrode surface 613*a*) 613 as shown in FIG. 19.

Next, description will be made about the light-emitting layer forming step (S114). In the light-emitting layer forming step, the nonpolar solvent insoluble to the hole-injecting/transporting layer 617*a* is used as the second composition solvent for use in forming the light-emitting layer so as to prevent the hole-injecting/transporting layer 617*a* from being dissolved again as described above.

On the other hand, however, the hole-injecting/transporting layer 617*a* has a low affinity for the nonpolar solvent. Therefore, even if the second composition containing the nonpolar solvent is ejected on the hole-injecting/transporting layer 617*a,* there is a possibility that the hole-injecting/transporting layer 617*a* cannot be brought into intimate contact with the light-emitting layer 617*b,* or that the light-emitting layer 617*b* cannot be evenly coated.

To enhance the affinity of the surface of the hole-injecting/transporting layer 617*a* with respect to the nonpolar solvent and the light-emitting layer forming material, it is preferable that the surface treatment (surface modification treatment) be performed before the light-emitting layer is formed. In the surface treatment, a surface modification material as a solvent identical with or similar to the nonpolar solvent of the second composition for use in forming the light-emitting layer is coated on the hole-injecting/transporting layer 617*a* and then dried.

Such treatments make it easy for the surface of the hole-injecting/transporting layer 617*a* to soak into the nonpolar solvent, and the second composition containing the light-emitting layer forming material can be evenly coated on the hole-injecting/transporting layer 617*a* in the following steps.

Figure 20:
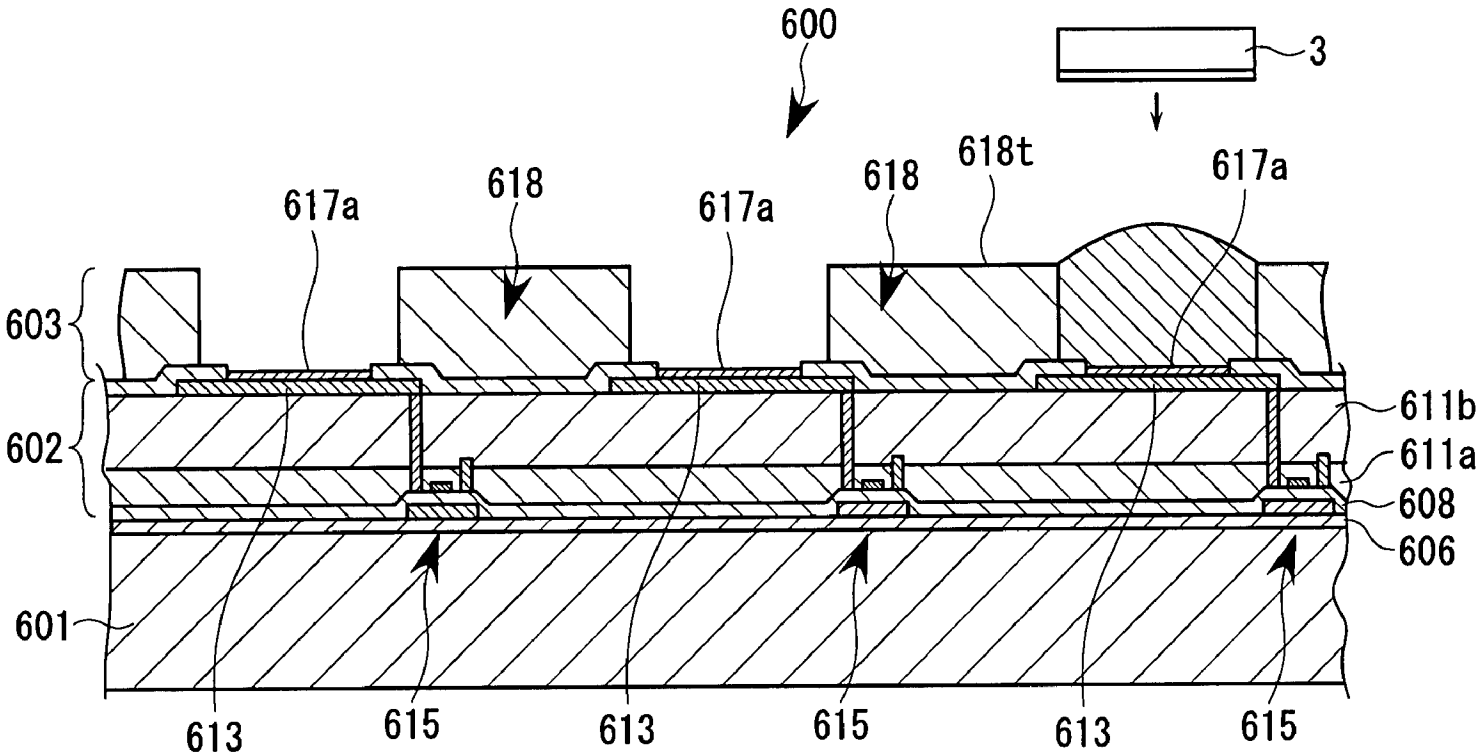
FIG. 20 is a process drawing explaining a step of forming a blue light-emitting layer.

Next, as shown in FIG. 20, a predetermined amount of the second composition containing the light-emitting layer forming material corresponding to any one of the colors (blue (B) in the example of FIG. 20) is implanted in the pixel region (opening portion 619) as a functional liquid droplet. The second composition implanted in the pixel region spreads over the hole-injecting/transporting layer 617*a* and is filled in the opening portion 619. Note that, in case that the second composition is shot on the top surface 618*t* of the bank portion 618 away from the pixel region, it will easily find its way into the opening portion 619 since the liquid-repellent treatment has been previously applied to the top surface 618*t* as described above.

Figure 21:
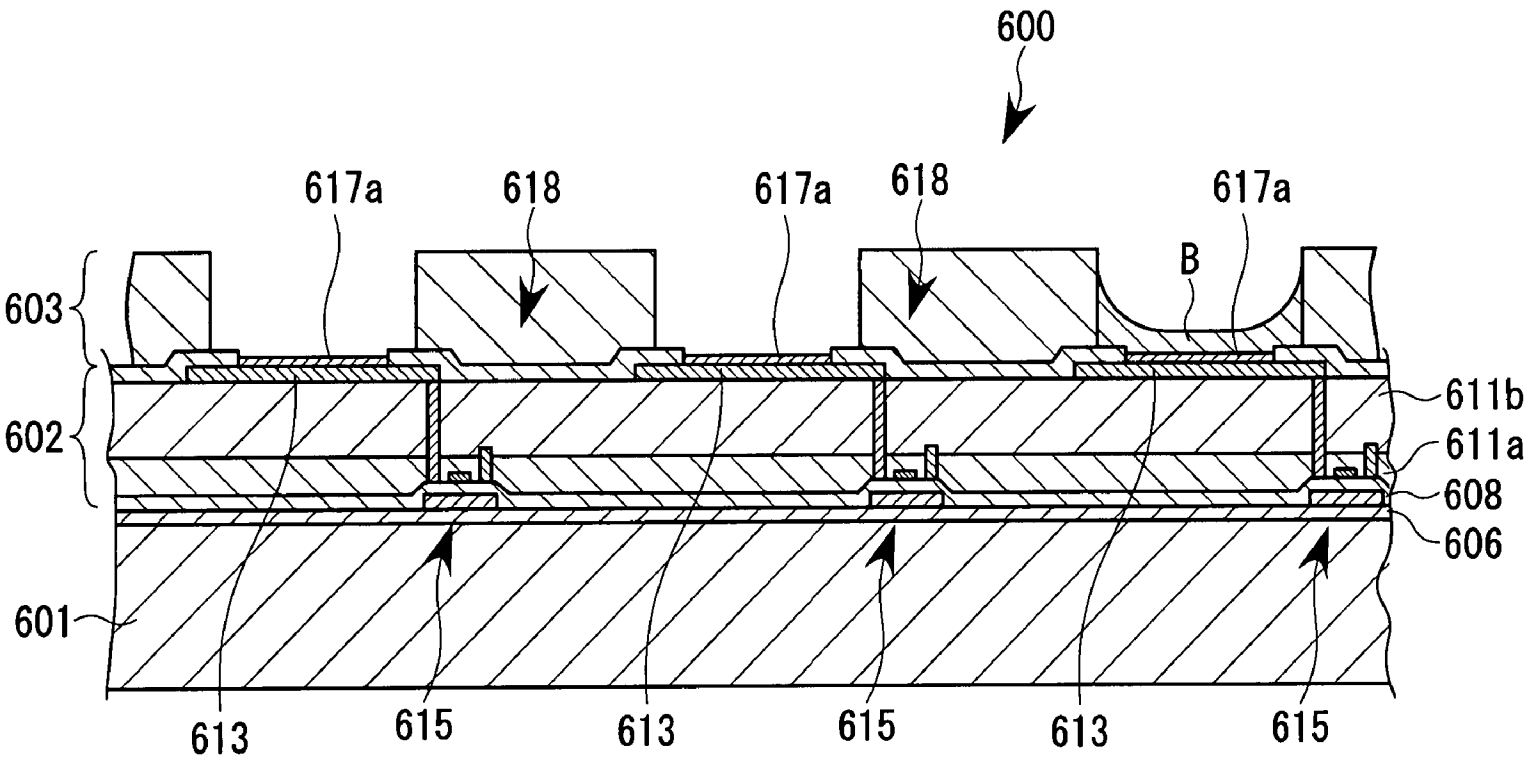
FIG. 21 is a process drawing explaining a state where the blue light-emitting layer is formed.

Subsequently, the second composition ejected is dried through a drying step, etc., making the nonpolar solvent contained in the second composition evaporate, and then forming the light-emitting layer 617*b* on the hole-injecting/transporting layer 617*a* as shown in FIG. 21. In the case of this figure, the light-emitting layer 617*b* corresponding to the blue color (B) is formed.

Figure 22:
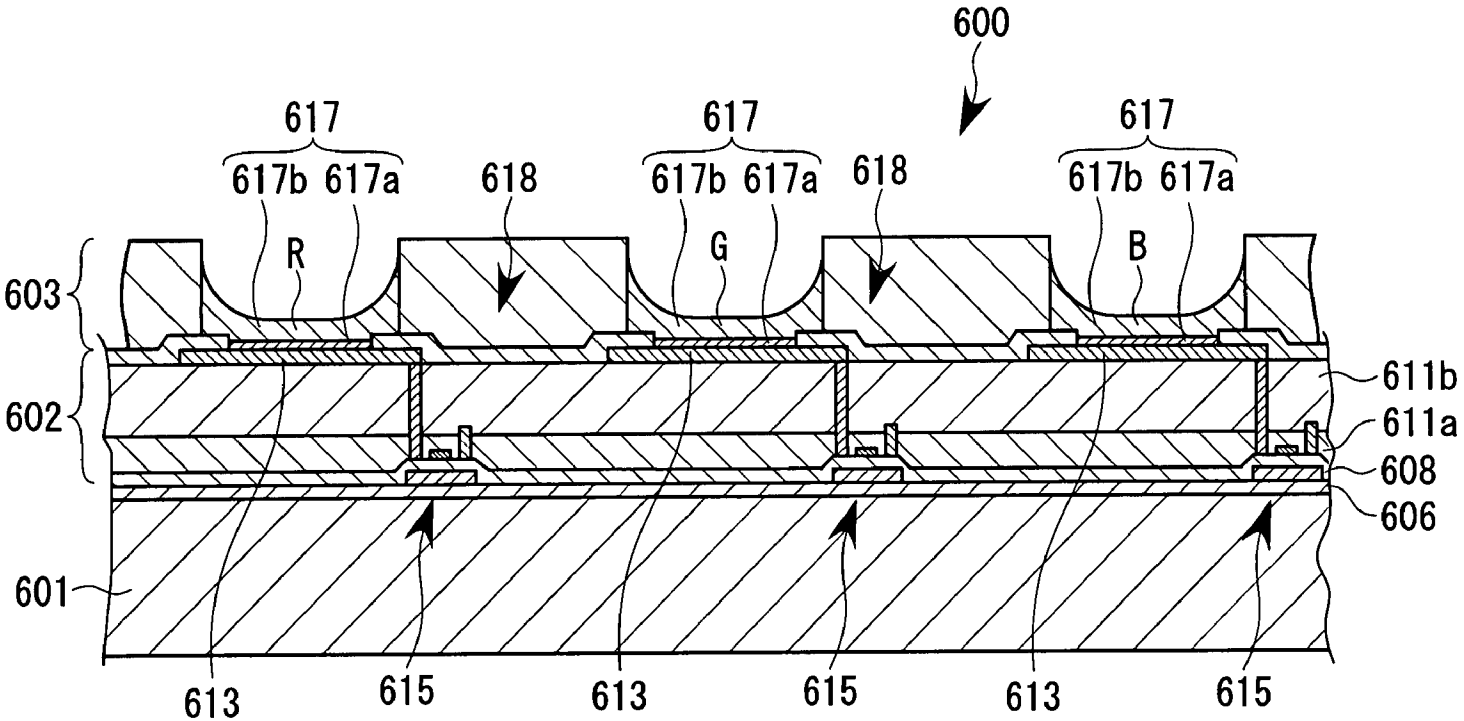
FIG. 22 is a process drawing explaining a state where light-emitting layers of each color are formed.

Similarly, as shown in FIG. 22, steps similar to that of the light-emitting layer 617*b* corresponding to the blue color (B) as described above are sequentially performed with the functional liquid droplet ejection head 3, and the light-emitting layers 617*b* corresponding to the other colors (red (R) and green (G)) are formed. Note that the order of forming the light-emitting layers 617*b* is not limited to the exemplified one, and the light-emitting layers may be formed in any order. For example, the order can be determined in accordance with the light-emitting layer forming material. Furthermore, examples of arrangement patterns for the three colors of R, G, and B include a strip arrangement, a mosaic arrangement, a delta arrangement, or the like.

In the manner as described above, the functional layer 617, namely, the hole-injecting/transporting layer 617*a* and light-emitting layer 617*b* are formed on each of the pixel electrodes 613. Then, the step is moved to the counter-electrode forming step (S115).

Figure 23:
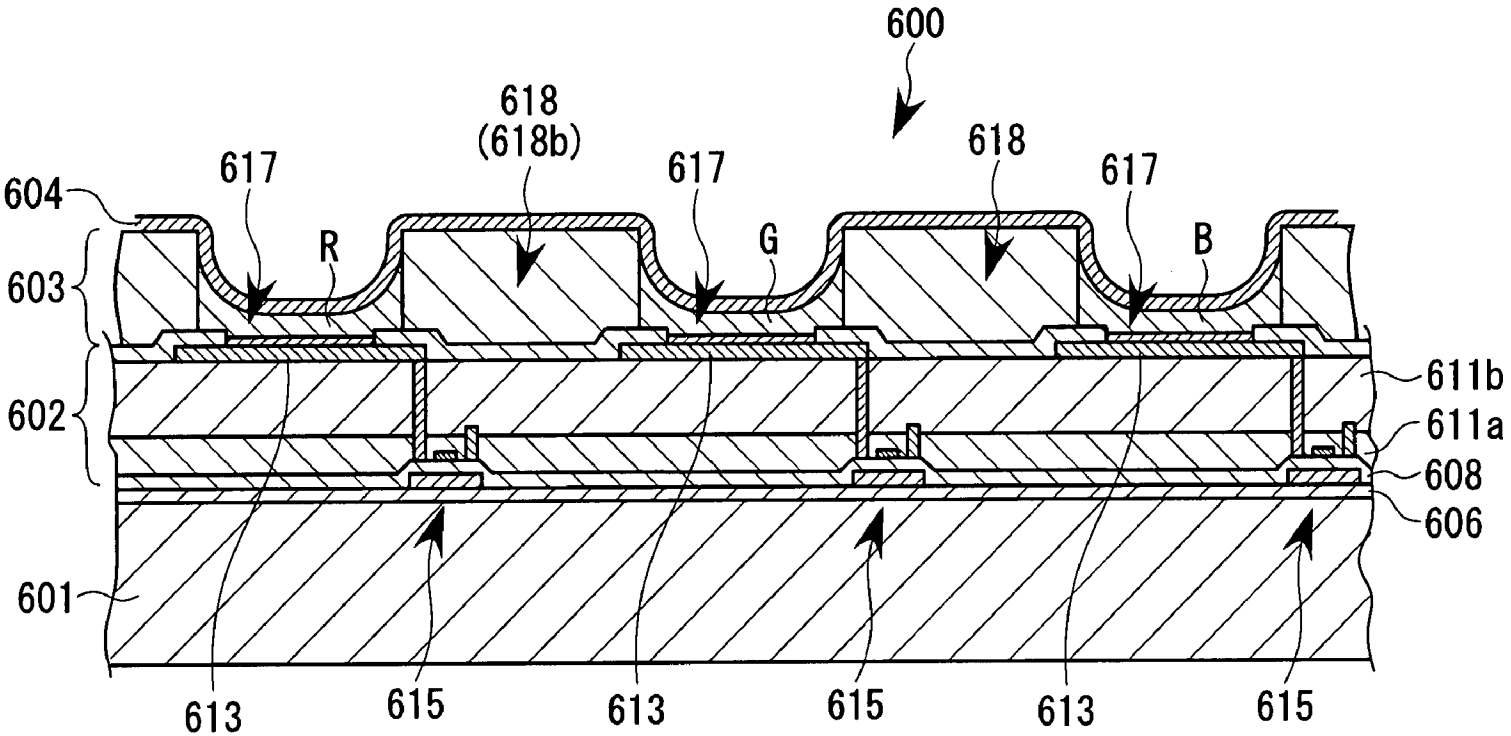
FIG. 23 is a process drawing explaining the formation of a cathode.

In the counter-electrode forming step (S115), as shown in FIG. 23, the cathode 604 (counter electrode) is formed on the whole surfaces of the light-emitting layers 617*b* and the organic bank layers 618*b* by, for example, vapor deposition, spattering, CVD (chemical vapor deposition), or the like. In the present embodiment, the cathode 604 has, for example, a calcium layer and an aluminum layer laminated therein.

The cathode 604 has properly disposed thereon an Al film or an Ag film as an electrode and a protection layer made of $SiO_2$, SiN, or the like for preventing the Al film or the Ag film from being oxidized.

After the cathode 604 is thus formed, when other treatments such as sealing treatment for sealing the top portion of the cathode 604 with a sealing member and wiring treatment are applied, the display device 600 is obtained.

Figure 24:
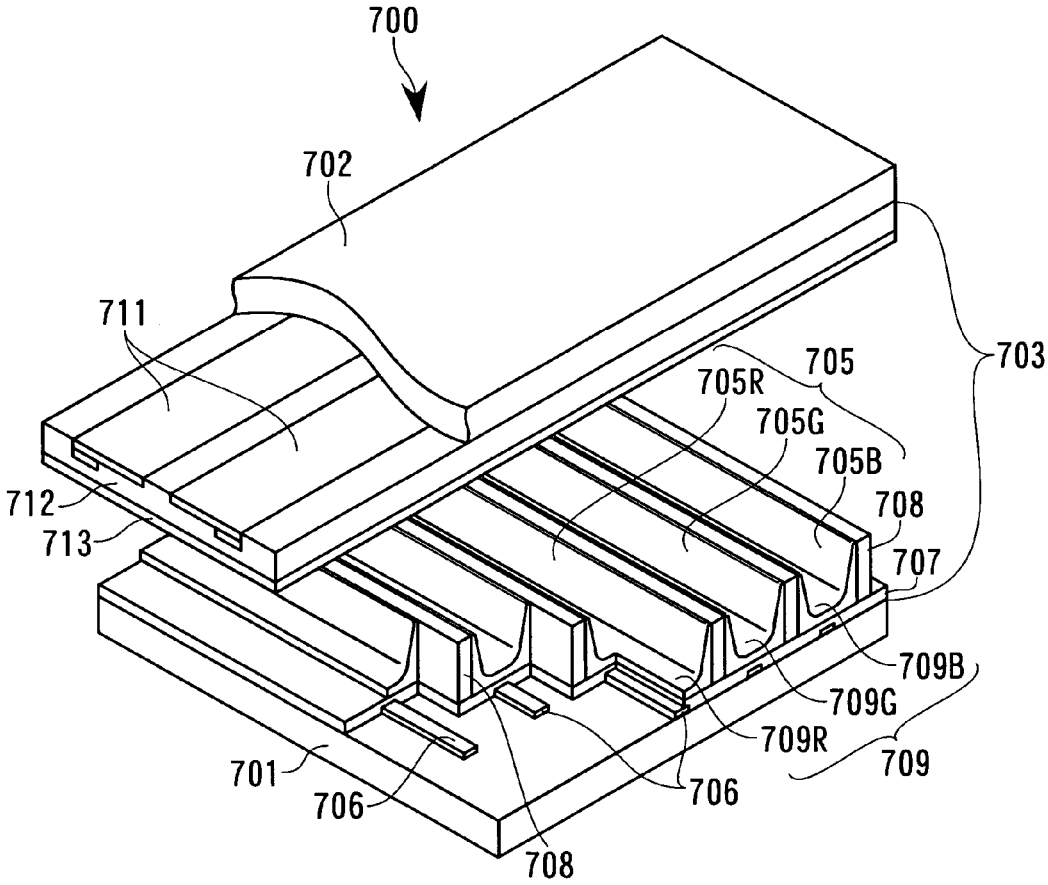
FIG. 24 is an exploded perspective view of an essential part of a display device as a plasma display panel (PDP device)

Next, FIG. 24 is an exploded perspective view of an essential part of a plasma display panel (PDP device: hereinafter, simply referred to as a display device 700). Note that the display device 700 is shown in a state where a part thereof is cut away.

The display device 700 is roughly constituted of mutually opposing first and second substrates 701 and 702 and a discharge display portion 703 held between the first and second substrates. The discharge display portion 703 is composed of a plurality of discharge chambers 705. Of the plurality of discharge chambers 705, a set of three discharge chambers 705 of a red discharge chamber 705R, a green discharge chamber 705G, and a blue discharge chamber 705B is arranged so as to constitute one pixel.

The first substrate 707 has address electrodes 706 formed on the top surface thereof in a stripe pattern at predetermined intervals, and a dielectric layer 707 is formed to cover the top surfaces of the address electrodes 706 and the first substrate 701. The dielectric layer 707 has partition walls 708 provided thereon in a standing manner, each being arranged between the respective address electrodes 706 and extending along the corresponding address electrodes 706. The partition walls 708 include those extending along the address electrodes 706 as shown in the figure and those (not shown) extending orthogonal to the address electrodes 706.

Areas partitioned by the partition walls 708 serve as the discharge chambers 705.

Each of the discharge chambers 705 has a phosphor 709 arranged therein. The phosphor 709 emits fluorescent light of any one of the colors red (R), green (G), or blue (B). The red, green, and blue discharge chambers 705R, 705G, and 705B have red, green, and blue fluorescent materials 709R, 705G, and 705B arranged at the bottom portions thereof, respectively.

The second substrate 702 has a plurality of display electrodes 711 formed on the bottom surface thereof, as shown in the figure, so as to extend in the direction orthogonal to the address electrodes 706 in a stripe pattern at predetermined intervals. To cover the display electrodes, a dielectric layer 712 and a protection film 713 made of MgO or the like are formed.

The first substrate 701 and the second substrate 702 are bonded to each other in a state where the address electrodes 706 and the display electrodes 711 lie orthogonal to each other. Note that the address electrodes 706 and the display electrodes 711 are connected to respective alternators (not shown).

When each of the electrodes 706 and 711 is energized, the phosphors 709 are excited to emit light in the discharge display portion 703, thereby providing color display.

According to the present embodiment, the address electrodes 706, the display electrodes 711, and the phosphors 709 can be formed with the liquid droplet ejection apparatus 1 as described in FIG. 1. Hereinafter, description will be made about a step of forming the address electrodes 706 of the first substrate 701.

In this case, the following step is performed in a state where the first substrate 701 is mounted on the set table 17 of the liquid droplet ejection apparatus 1.

First, a liquid material (functional liquid) containing a material for forming a conductive-film wiring is, as a functional liquid droplet, shot into a region of forming an address electrode with the functional liquid droplet ejection heads 3. The liquid material contains conductive fine particles made of a metal or the like, dispersed into a disperse medium, as a material for forming a conductive-film wiring. As the conductive fine particles, metal fine particles containing, for example, gold, silver, copper, palladium, nickel, and a conductive polymer or the like are used.

When replenishment of the liquid material in the whole region of forming address electrodes to be objected is finished, the ejected liquid material is subjected to drying treatment and the disperse medium contained in the liquid material is evaporated, thereby forming the address electrodes 706.

Meanwhile, as the address electrodes 706 are formed in the above, the display electrodes 711 and the phosphors 709 can also be formed by way of each of the above-described steps.

To form the display electrodes 711, a liquid material (functional liquid) containing a material for forming a conductive film wiring is, as a functional liquid droplet, shot into a region of forming a display electrode in the same manner as that of the address electrodes 706.

To form the phosphors 709, a liquid material (functional liquid) containing a luminescent material corresponding to each of the colors, R, G, and B, is ejected from the functional liquid droplet ejection heads 3 and shot into the discharge chambers 705 of the corresponding colors.

Figure 25:
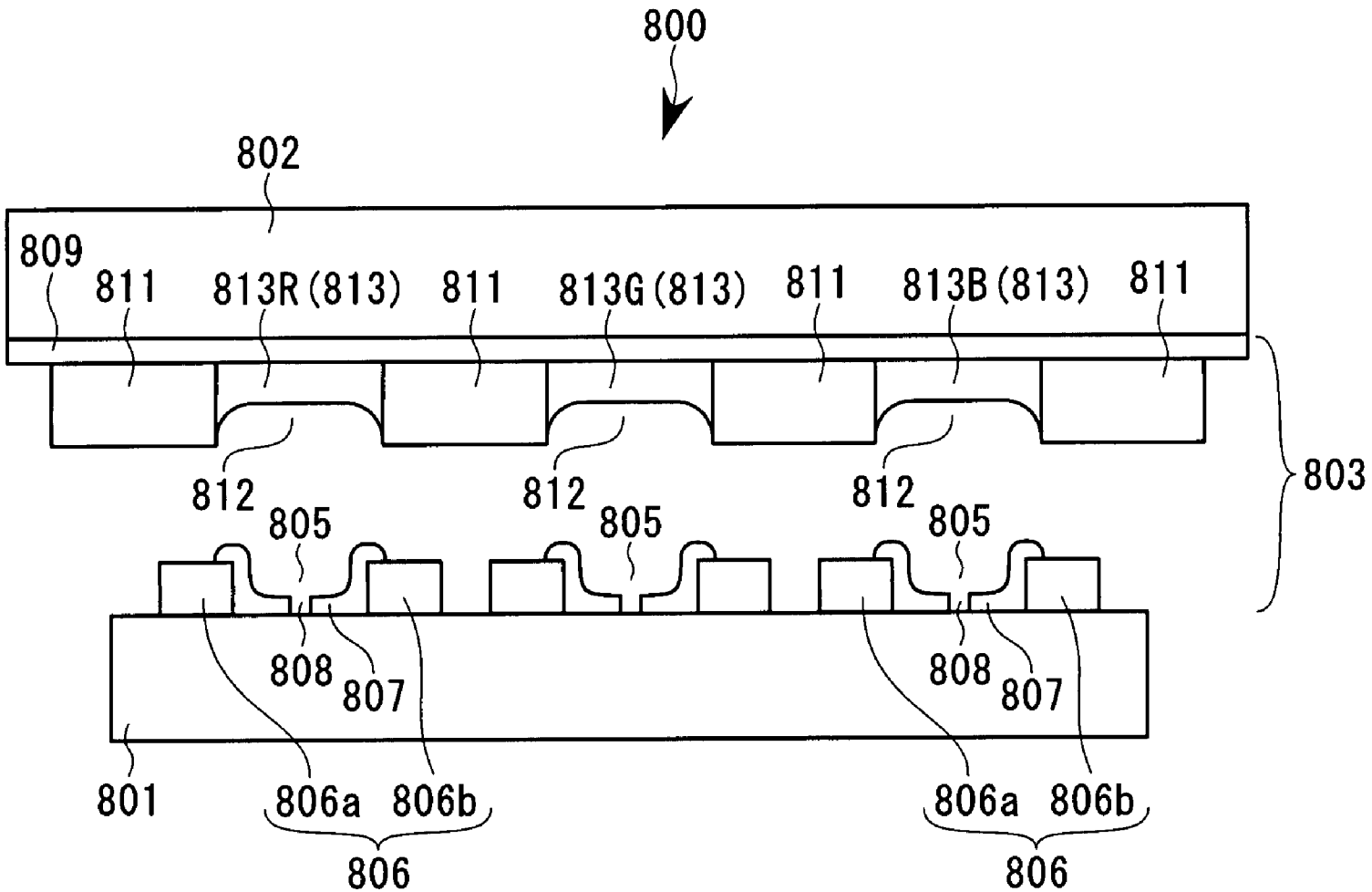
FIG. 25 is a cross section of an essential part of a display device as an electron emission device (FED device)

FIG. 25 is a cross section of an essential part of an electron emission device (also called FED or SED, hereinafter simply referred to as a display device 800). Note that, in the figure, the display device 800 is in a state where a part thereof is shown in cross section.

The display device 800 is roughly constituted of mutually opposing first and second substrates 801 and 802, and a field-emission display portion 703 held between the first and second substrates. The field-emission display portion 803 is composed of a plurality of electron-emitting portions 805 arranged in a matrix pattern.

The first substrate 801 has first and second element electrodes 806*a* and 806*b* constituting cathode electrodes 806 formed on the top surface thereof so as to be mutually orthogonal to each other. Furthermore, in a part partitioned by each of the first and second element electrodes 806*a* and 806*b*, a conductive film 807 having a gap formed therein is formed. In other words, the first element electrodes 806*a*, the second element electrodes 806*b*, and the conductive films 807*c* constitute the plurality of electron-emitting portion 805. Each of the conductive films 807 is made of palladium oxide (PdO) or the like, and the gap 808 is formed, for example, by means of foaming after the conductive film 807 is formed.

The second substrate 802 has anode electrodes 809 formed on the bottom surface thereof so as to oppose the cathode electrodes 806. Each of the anode electrodes 809 has bank portions 811 formed in a lattice pattern on the bottom surface thereof. In each of opening portions 812 oriented downward surrounded by the bank portions 811, phosphors 813 are arranged so as to correspond to the electron-emitting portions 805. The phosphors 813 emit fluorescent light of any one of the colors red (R), green (G), or blue (B). In each of the opening portions 812, red, green, and blue fluorescent materials 813R, 813G, and 813B are arranged in the above-described predetermined pattern.

The first substrate 801 and the second substrate 802 thus formed are bonded to each other so as to have a small gap therebetween. In the display device 800, an electron emitted from the first element electrodes 806*a* or the second element electrodes 806*b* as a cathode hits upon the phosphor 813 formed on the anode electrode 809 as an anode via the conductive film (gap 808) 807 so as to be excited to emit light, thereby providing color display.

In the same manner as those of other embodiments, the first element electrodes 806*a*, the second element electrodes 806*b*, the conductive films 807, and the anode electrodes 809 can be formed with the liquid droplet ejection apparatus 1, and the phosphors 813R, 813G, 813B corresponding to each of the colors can be formed with the liquid droplet ejection apparatus 1.

Figure 26A:
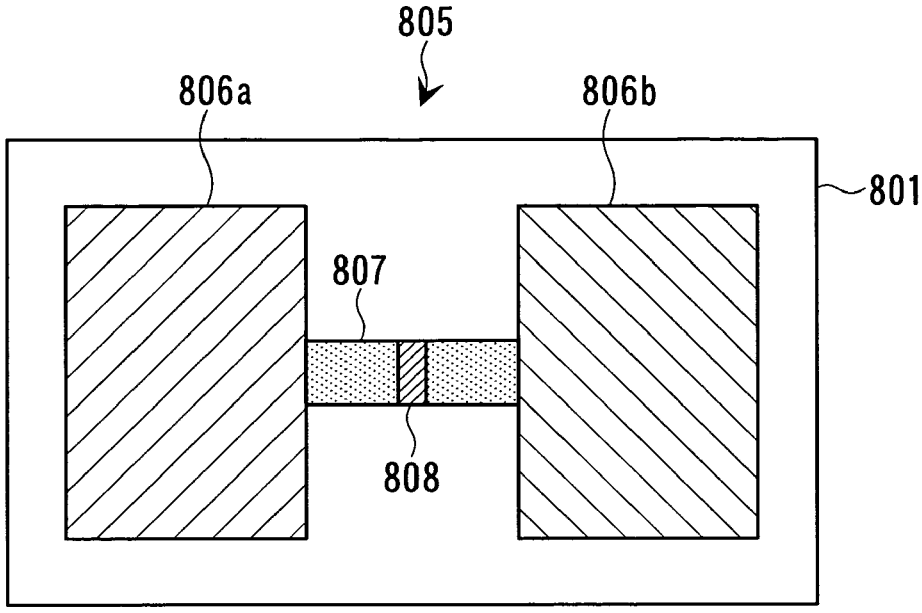
FIGS. 26A and 26B are plan views, each showing an electron-emitting portion and its surrounding components of the display device and a method of forming thereof.
Figure 26B:
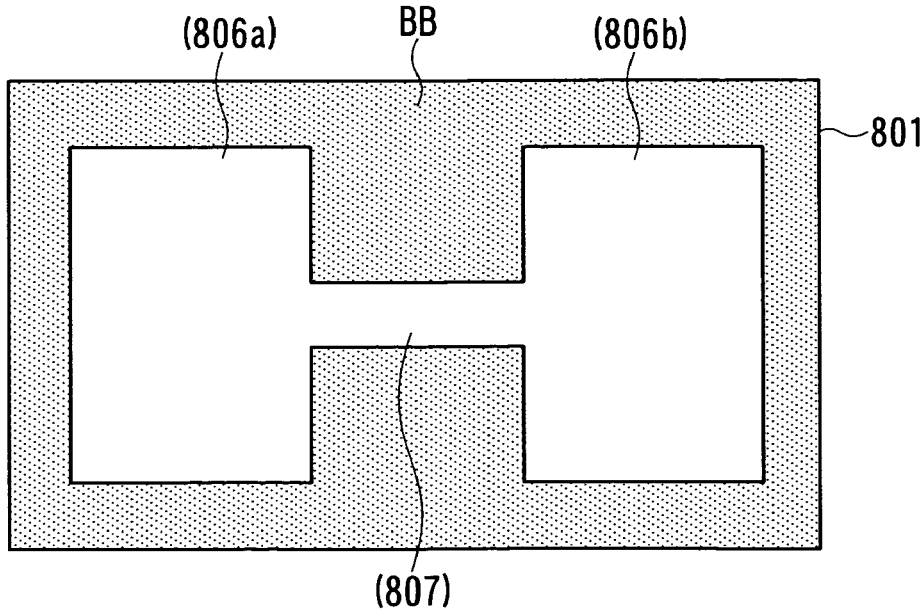

The first element electrode 806*a*, the second element electrode 806*b*, and the conductive film 807 are formed in a plan shape as shown in FIG. 26A. To deposit the first element electrode, the second element electrode, and the conductive film, a bank portion BB is formed (by means of photolithography process), while a portion where the first element electrode 806*a*, the second element electrode 806*b*, and the conductive film 807 are to be formed is left intact. Next, the first element electrode 806*a* and the second element electrode 806*b* are formed (by an ink-jet method of the liquid droplet ejection apparatus 1) in a groove portion constituted by the bank portion BB, the solvent used therefor is dried to deposit the above components, and then the conductive film 807 is formed (by an ink-jet method of the liquid droplet ejection apparatus 1). After the conductive film 807 is deposited, the bank portion BB is removed (by an ashing process), and then the above-described forming process is performed. Note that, in the same manner as the organic EL device as described above, it is preferable that the first and second substrates 801 and 802 and the bank portion 811 and BB be subjected to lyophilic treatment and liquid-repellent treatment, respectively.

Furthermore, examples of electro-optic devices include devices for forming metal wiring, lens, resist, light diffuser, or the like. Various electro-optic devices can efficiently be manufactured when the above-described liquid droplet ejection apparatus 1 is applied for manufacturing the same.

It is further understood by those skilled in the art that the foregoing is the preferred embodiment of the present invention, and that various changes and modifications may be made without departing from the spirit and scope thereof.

What is claimed is:

1. An initial filling method for a functional liquid droplet ejection head in which a filling liquid consisting essentially of a functional liquid or a solvent thereof is initially filled in a passage of a functional liquid droplet ejection head for ejecting a functional liquid droplet on a workpiece, the method comprising:

a sealing step of sealing a functional liquid introducing port of the functional liquid droplet ejection head communicating with the passage of the head;

an immersing step of immersing only a nozzle surface side end portion of a head main body of the functional liquid droplet ejection head in the filling liquid stored in a sealed vessel;

a pressure-reducing step of reducing pressure inside the sealed vessel to a predetermined degree of vacuum by exhausting the atmosphere inside the sealed vessel; and a pressure-restoring step of restoring the pressure inside the sealed vessel after the pressure-reducing step.

2. The initial filling method for a functional liquid droplet ejection head according to claim 1, wherein the predetermined degree of vacuum is kept for several hours in the pressure-reducing step.

3. The initial filling method for a functional liquid droplet ejection head according to claim 1, wherein the predetermined degree of vacuum is smaller than or equal to 1000 Pa and greater than or equal to 100 Pa.

4. An initial filling apparatus for a functional liquid droplet ejection head, which initially fills a filling liquid consisting essentially of a functional liquid or a solvent thereof in a passage of the functional liquid droplet ejection head for ejecting a functional liquid droplet on a workpiece, the apparatus comprising:

a sealed vessel for storing the filling liquid therein;

a head supporting unit for supporting a nozzle surface side end portion of the functional liquid droplet ejection head whose functional liquid introducing port communicating with the passage of the head is previously sealed, the head supporting unit immersing only the nozzle surface side end portion in the filling liquid;

a pressure-reducing unit communicating with the sealed vessel for reducing pressure inside the sealed vessel to a predetermined degree of vacuum by exhausting the atmosphere inside the sealed vessel; and a pressure-restoring unit for restoring the pressure inside the sealed vessel after the degree of vacuum is kept for predetermined hours.

5. The initial filling apparatus for a functional liquid droplet ejection head according to claim 4, wherein the pressure-restoring unit is composed of a valve communicating with a dried-air supplying apparatus.

6. A functional liquid droplet ejection head in which a filling liquid consisting essentially of a functional liquid or a solvent thereof is initially filled by an initial filling apparatus, the functional liquid droplet head comprising:

a passage for ejecting a functional liquid droplet on a workpiece;

a functional liquid introducing port communicating with the passage, the functional liquid introducing port being adapted to receive functional liquid from a liquid droplet ejection apparatus in which the functional liquid droplet head is installable;

a seal for selectively sealing the functional liquid introducing port; and a nozzle surface side end portion that is supportable by a head supporting unit of the initial filling apparatus and isolatably immersible in the filling liquid stored in a sealed vessel of the initial filling apparatus after the functional liqiuid introducing port is sealed so that the passage initially fills with the filling liquid by reducing a pressure inside the sealed vessel to a predetermined degree of vacuum by exhausting the atmosphere inside the sealed vessel and then restoring the pressure inside the sealed vessel after the degree of vacuum is kept for predetermined hours.

7. A functional liquid supplying apparatus for supplying a functional liquid to the functional liquid droplet ejection head according to claim 6, the apparatus comprising:

a functional liquid tank for storing the functional liquid; and a functional liquid supplying tube for connecting the functional liquid droplet ejection head and the functional liquid tank.

8. A liquid droplet ejection apparatus comprising:

the functional liquid supplying apparatus according to claim 7;

a head unit in which the functional liquid droplet ejection head is mounted on a carriage; and a moving mechanism for mounting a workpiece thereon and moving the head unit relative to the workpiece.

* * * * *